US005957063A

United States Patent [19]

Koseki et al.

[11] Patent Number: 5,957,063

[45] Date of Patent: Sep. 28, 1999

[54] COMBUSTION SYSTEM AND OPERATION CONTROL METHOD THEREOF

[75] Inventors: Hidenori Koseki; Hiroaki Shigeoka, both of Tokyo, Japan

[73] Assignee: Mitsubishi Denki Kabushiki Kaisha, Tokyo, Japan

[21] Appl. No.: 08/861,656

[22] Filed: May 22, 1997

[30] Foreign Application Priority Data

Sep. 12, 1996 [JP] Japan ..... 8-241991

[51] Int. Cl.[6] ..... F23N 3/18; F23N 5/00

[52] U.S. Cl. ..... 110/188; 110/185; 110/190; 110/229; 431/12; 236/15 E; 236/15 R

[58] Field of Search ..... 110/185, 186, 110/188, 190, 203, 210, 211, 214, 229, 346; 236/15 E, 15 R; 431/12, 68

[56] References Cited

U.S. PATENT DOCUMENTS

| | | | |
|---|---|---|---|
| 3,205,359 | 9/1965 | Guiffrida | 431/68 |
| 3,301,307 | 1/1967 | Nishigaki et al. . | |
| 4,362,499 | 12/1982 | Nethery | 431/12 |
| 4,449,918 | 5/1984 | Spahr | 236/15 E X |
| 4,517,906 | 5/1985 | Lewis et al. | 236/15 E X |
| 4,531,905 | 7/1985 | Ross | 431/12 |
| 4,533,315 | 8/1985 | Nelson | 431/20 |
| 4,588,372 | 5/1986 | Torborg | 431/78 |
| 4,761,744 | 8/1988 | Singh et al. | 236/15 E X |
| 4,870,910 | 10/1989 | Wright et al. | 110/190 |
| 4,984,524 | 1/1991 | Mindermann et al. | 236/15 E X |
| 5,078,100 | 1/1992 | Huschauer et al. | 110/190 X |
| 5,158,024 | 10/1992 | Tanaka et al. | 110/186 |
| 5,160,259 | 11/1992 | O'Hara et al. | 236/15 E X |
| 5,176,086 | 1/1993 | Clark et al. | 110/346 |
| 5,190,454 | 3/1993 | Murray et al. | 431/12 X |
| 5,401,162 | 3/1995 | Bonne | 431/12 |
| 5,425,316 | 6/1995 | Malone | 110/190 |
| 5,501,159 | 3/1996 | Stevers et al. | 110/188 |
| 5,520,123 | 5/1996 | Chappell et al. | 110/188 |

FOREIGN PATENT DOCUMENTS

| | | | |
|---|---|---|---|
| 0 055 852 | 7/1982 | European Pat. Off. . | |
| 0 104 586 | 4/1984 | European Pat. Off. . | |
| 0 221 799 | 5/1987 | European Pat. Off. . | |
| 0 399 994 | 11/1990 | European Pat. Off. | 236/15 E X |
| 0 543 480 | 5/1993 | European Pat. Off. . | |
| 0 694 737 | 1/1996 | European Pat. Off. . | |
| 6-74435 | 3/1994 | Japan | F23G 5/50 |
| 6-86926 | 3/1994 | Japan | B01J 2/00 |
| 6-213423 | 8/1994 | Japan | F23G 5/00 |
| 6-288529 | 10/1994 | Japan | F23G 5/50 |
| 6-331122 | 11/1994 | Japan | F23G 5/50 |
| 6-341629 | 12/1994 | Japan | F23G 5/50 |
| 7-39854 | 2/1995 | Japan | B09B 5/00 |
| 7-55125 | 3/1995 | Japan | F23G 5/50 |
| 7-119946 | 5/1995 | Japan | F23G 5/50 |
| 7-133917 | 5/1995 | Japan | F23G 5/50 |
| 7-167419 | 7/1995 | Japan | F23G 5/50 |
| 2003928 C1 | 11/1993 | Russian Federation | 236/15 E X |
| 1 565 310 | 4/1980 | United Kingdom . | |

*Primary Examiner*—Ira S. Lazarus
*Assistant Examiner*—Ljiljana V. Ciric
*Attorney, Agent, or Firm*—Sughrue, Mion, Zinn, Macpeak & Seas, PLLC

[57] ABSTRACT

A combustion system is divided into a thermal decomposition section and a combustion section. The thermal decomposition section thermally decomposes or partially bums solid combustibles, thereby generating combustible gases. The quantity or quality of the generated combustible gases is measured, and combustion air corresponding to the measured value is supplied to the combustion section. The quality and temperature of the combustible gases in the thermal decomposition section are detected, and the quantity of solid combustibles and air (or the quantity of heat) supplied to the thermal decomposition section are controlled.

13 Claims, 11 Drawing Sheets

COMBUSTION SYSTEM AND OPERATION CONTROL METHOD THEREOF

BACKGROUND OF THE INVENTION

1. Field of the Invention

The present invention relates to a combustion system for use with solid combustibles, and more particularly to combustion systems and to their operation control methods for use with waste which have unknown stoichiometric air-to-fuel ratios as fuels.

2. Description of the Related Art

FIG. 12 is a cross-sectional view of a conventional gasifying combustion incinerator (a dry distillation incinerator) disclosed in a publication (e.g., "A Hundred Pieces of Selected Waste Treatment Techniques," in 1993, by the Kankyo Kogai Shinbun Co., Ltd.). In the drawing, reference numeral 1 designates a waste inlet which doubles as a safety valve; 2*a* designates a dry distillation incinerator (a thermal decomposition incinerator); 2*b* designates an incinerator installed separately from the distillation incinerator 2*a*; 4 designates a dry distillation air vent for supplying dry distillation air to the dry distillation incinerator 2*a*; 6 designates a dry distillation air chamber of the dry distillation incinerator 2*a*; 9 designates a combustion space; 11*a* designates a burner for starting the dry distillation incinerator; 11*b* designates a burner for starting the incinerator 2*b*; and 12 designates a combustion air vent. Reference numeral 14 designates a combustion air chamber of the incinerator 2*b* which communicates with the inside of the incinerator 2*b* through the combustion air; 15 designates a dry distillation gas flow channel (for thermally-decomposed gases) which permits communication between the dry distillation incinerator 2*a* and the incinerator 2*b*; 101*a* and 101*b* designate temperature sensors; 102*a*, 102*b*, and 102*c* designate airflow control valves.

The operation of the foregoing conventional gasifying combustion incinerator will be described. First, combustible waste is fed into the dry distillation incinerator 2*a* through the waste inlet 1, and dry distillation air is fed into the dry distillation incinerator 2*a* through the dry distillation air chamber 6 and the dry distilled air vent 4. A combustion-supporting oil is fed to the starting burner 11*a*, and partial combustion of the waste is initiated inside the base of the dry distillation incinerator 2*a*. The adjoining portions of the waste are heated by the heat of the combustion, and partial combustion of the waste progresses continuously in the insufficient quantity of air in an upward direction. At this time, dry distillation combustible gases (hereinafter referred to as "thermally-decomposed gases") which contain a large quantity of unburned gas develop in the dry distillation incinerator 2*a*, and these gases are fed to the incinerator 2*b* via the thermally-decomposed gas flow channel 15. Since the dry decomposed gas developed immediately after the initiation of the dry distillation contains a small proportion of combustible components, the combustion of the gas is supported by the starting burner 11*b* in the incinerator 2*b*. After full-scale generation of thermally-decomposed gases and sufficient heating of the inside of the combustion chamber 9 have been achieved, the thermally-decomposed gases are mixed with combustion air which is introduced into the combustion chamber 9 via the combustion air chamber 14 and the combustion air vent 12. The thus-mixed gas causes spontaneous combustion, and the starting burner 11*b* is stopped at this time.

The combustion in the incinerator 2*b* is controlled so as to make the temperature of the combustion gas stable by the detection of the temperature of the combustion gas developed in the incinerator 2*b* through use of the temperature sensor 101*b*, and by the regulation of the rate of flow of distilled air into the dry distillation incinerator 2*a* and the rate of combustion air flowing into the incinerator 2*b* by the respective airflow control valves 102*b* and 102*c*.

FIG. 13 is a cross-sectional view showing the structure of a conventional stoker fired furnace disclosed in; e.g., Unexamined Japanese Patent Application No. Hei-6-213423. In the drawing, reference numeral 1 designates a hopper which is a waste inlet for an incinerator 2; 3 designates a pusher for feeding the waste fed in the hopper 1 into the incinerator 2; and 4 designates stokers or grates for drying, burning, and post-burning of the waste, in which they are classified as a drying stoker 4*a*, a burning stoker 4*b*, and a post-burning stoker 4*c* in the order from the one being closest to the pusher 3. Reference numeral 5 designates a primary air blower for supplying primary air to the stokers 4*a* to 4*c*; 6 designates a primary air flow channel which permits communication between the lower portions of the stokers 4*a* to 4*c* and the primary air blower 5; 7 designates a burned ash inlet into which ash resulting from the burning of the waste in the stoker 4*c* is fed; and 9*a*, 9*b* designate combustion spaces above the stokers 4, i.e., freeboard, wherein 9*a* is a primary combustion area, and 9*b* is a secondary combustion area. Reference numeral 11 designates a starting burner; 12 designates a secondary blower for supplying secondary air to a secondary combustion area 9*b*; 13 designates a monitoring camera for observing the state of combustion of the waste on the stokers 4*a* to 4*c*; 14 designates a waste heat boiler; 15 designates a turbogenerator; and 16 designates an exhaust gas processing facility.

Next, the operation of the foregoing stoker fired furnace will be described. At the time of starting-up of the stoker fired furnace, waste is introduced into the hopper 1. The accumulated waste is fed from its bottom to the stokers 4 by the pusher 3. The waste supplied onto the stokers 4 is fed in order from the drying stoker 4*a* to the burning stoker 4*b*. At this time, the primary air is supplied to the base of the respective stokers 4*a*, 4*b*, and 4*c* from the primary air blower 5 by way of the primary air flow channel 6. The starting burner 11 is then activated so as to ignite the waste held on the stokers 4*a* to 4*c*. The waste held on the burning stoker 4*b* is burned, and then the thus-burned waste is fed to the post-burning stoker 4*c* by virtue of the movement of the stoker 4*b*. At the same time, new waste is fed to the drying stoker 4*a* by the pusher 3.

An unburned-component-contained gas resulting from the partial combustion of the waste in the insufficient quantity of air on the burning stoker 4*b* is substantially completely burned by introducing secondary air supply into the secondary combustion area 9*b* from the secondary air blower 12. Thermal energy from the combustion of the gas is converted into thermal energy of steam by the waste heat boiler 14 disposed downstream from the secondary combustion area 9*b*. The thus-converted thermal energy is further converted into electrical energy by; e.g., the turbogenerator 15. The exhaust gas processing facility 16 removes fly ash and acid gas from the combustion gas that has passed through the waste heat boiler 14. The waste that is in flames is sent to the post-burning stoker 4*c* from the burning stoker 4*b* where it is completely reduced to ashes, and the resultant ashes are supplied to the burned ash inlet 7.

The state of combustion in the incinerator 2 is monitored by a combustion gas temperature monitor (not shown), the concentration of oxygen in the exhaust gas, or the positions of flames which develop on the burning stoker 4*b* and are observed by the monitoring camera 13. The combustion of the waste is controlled by regulating a feed rate of waste to the stokers 4 and the flow rates of the primary and secondary air such that complete combustion of the waste fired on the burning stoker 4*b* and a predetermined concentration of oxygen in the exhaust gas are achieved, and constant thermal load is imposed on the waste heat boiler 14.

FIG. 14 is a cross-sectional view illustrating the structure of a fluidized bed furnace disclosed in the publication (e.g., "Practical Designing of a Fluidized Bed Furnace," the enlarged and revised edition, on Aug. 20, in 1994, by the Kogyo Shuppan Co. Ltd.). In the drawing, reference numeral 2 designates the main unit of a fluidized bed furnace; 3 designates a waste feeder; 4 designates a fluidized bed; 6 designates a fluidized air inlet; and 61 designates a fluidized air chamber. Reference numeral 62 designates a distribution plate, and sand which serves as a bed material on top of the distribution plate 62. Reference numeral 7 designates an incombustible extraction pipe provided underneath the fluidized bed 4; 8 designates an incombustible extraction device; 81 designates a vibrating screen for separating incombustible from fluid sand; 82 designates a fluid sand circulation system; 9 designates a freeboard formed above the fluidized bed 4; 10 designates an auxiliary fuel supply gun; 11 designates a starting burner; and 12 designates a secondary air nozzle for supplying secondary air to the freeboard 9.

Next, the operation of the fluidized bed furnace will be described. Fluidized air (which doubles as primary air) which is used for constituting a fluid layer is guided from the fluidized air inlet 6 to the inside of the fluidized bed furnace 2 via the fluidized air chamber 61 and the distribution plate 62. The sand accumulated on the distribution plate 62 forms a fluid layer because of the fluidized air, and the fluid layer is heated by the starting burner 11. When the temperature of the fluid layer reaches a temperature (of about 700 degrees centigrade) which is suitable for the combustion of the waste, the waste feeder 3 feeds waste onto the fluidized bed 4, and the waste is immediately dried, thermally decomposed, and partially burned. The resultant combustible gases (hereinafter referred to as thermally-decomposed gases) are mixed with the secondary air introduced through the secondary air nozzle 12 within the freeboard 9 above the fluidized bed 4. The waste is substantially burned completely. Incombustible left in the fluidized bed 4 are extracted by the incombustible extraction device 8 by way of the incombustible extraction pipe 7. The extracted materials are divided into sand and incombustible, and the sand is returned to the fluidized bed by way of the fluid sand circulation system 82.

The waste is vigorously mixed with hot sand of the fluidized bed 4 in the fluidized bed furnace, thereby providing a high reaction rate and leading to drying, thermal decomposition, and partial burning of the waste within a short period of time. For this reason, there is a tendency for the fluidized bed furnace to be apt to incompletely burn waste if there are variations in the quantity and quality of the waste. For example, if there is an increase in a proportion of plastic materials in the waste, a shortage in the combustion results in a hike in the concentration of CO in the exhaust gas.

To prevent such a problem, there is another example contrived to suppress the incomplete combustion of waste by partially fluidizing the fluidized bed 4 so as to make the reaction mild (refer to a publication entitled "A Collection of Research Papers Presented at the 12th National City-cleaning Workshop," February 1992). However, this method also fails to provide sufficient countermeasures against variations in the quality of solid waste.

The following are examples of conventional combustion control methods, and the items to be measured and the control to be used are detailed below.

Unexamined Japanese Patent Application No. Hei-7-133917

Items to be measured: the quantity of combustion air, the concentration of oxygen in an exhaust gas, and the temperature of the exhaust gas, Items to be controlled: the quantity of combustion air, a feed rate of refuse, a rate of travel of the waste between stokers, and the diffluence of the combustion air, Unexamined Japanese Patent Application No. Hei-7-119946

Items to be measured: the volume and weight of waste within a hopper,

Items to be controlled: an increase or decrease in the supply of waste, combustion, and the processing of flue gas, Unexamined Japanese Patent Application No. Hei-6-341629

Items to be measured: the temperature of air supply, the temperature of a fluid layer, the temperature of the exhaust gas, a flow rate of primary air, and a flow rate of secondary air, Items to be controlled: a flow rate of and a distribution ratio between the combustion air in a fluid layer and combustion air in the freeboard, Unexamined Japanese Patent Application No. Hei-7-167419

Items to be measured: the brightness of the inside of an incinerator, and the concentration of oxygen in the exhaust gas, Items to be controlled: a feed rate of garbage, and a feed rate of combustion air, Unexamined Japanese Patent Application No. Hei-6-74435

Items to be measured: a load current of a motor used for driving waste supply means, and the temperature of gas within an incinerator, Items to be controlled: a flow rate of loading of materials to be burned, and a flow rate of secondary air, Unexamined Japanese Patent Application No. Hei-6-331122

Item to be measured: a burn-off point through use of an infrared ray,

Items to be controlled: a travel speed of waste, and a feed rate of air supply,

Unexamined Japanese Patent Application No. Hei-6-288529

Item to be measured: the concentration of specific components in the exhaust gas, the components developing in a post-burning zone of a stoker, Unexamined Japanese Patent Application No. Hei-7-39854

Item to be measured: a feed rate of waste,

Unexamined Japanese Patent Application No. Hei-6-86926

Item to be measured: images of the inside of an incinerator (images of the flames), Unexamined Japanese Patent Application No. Hei-7-55125

Item to be measured: images of the inside of an incinerator (the distribution of brightness within the incinerator) (detection of the position of combustion and a burn-off point), As described above, combustion control based on the measurement of a feed rate of waste, the quantity of combustion air, the temperature of combustion air, the temperature of an exhaust gas, the concentration of oxygen in the exhaust gas, the concentration of specific components in the exhaust gas, and images of the inside of an incinerator.

A conventional solid waste combustion system has the aforementioned structure and is operated in the previously-described manner. With regard to the combustion control, there are some examples in which the quantity of waste is roughly ascertained, similar to the previous examples. However, there are no examples in which variations in the quality of waste are previously detected, and control suitable for those variations is not effected in the current state of the art. Particularly, the quality of waste, more specifically stoichiometric air required to burn the waste (namely, the optimum quantity of air used in burning fuel) is not ascertained at all. As a result of this, a suitable quantity of air is not supplied in response to variations in the quality of supplied waste, thereby resulting in a sharp increase in the concentration of CO in the exhaust gas as well as an increase in the temperature of combustion gas developed in the incinerator. Further, this causes variations in the temperature of steam in a boiler subjected to thermal load, as well as an increase in the concentration of CO in the exhaust gas leading to the discharge of deadly poisonous dioxins.

Some of incinerators have recently begun to adopt fuzzy control in which a conceptual quantity that cannot have been quantified by a conventional technique is converted into numbers by unification and combination of various types of information about quantities related to the incinerator through fuzzy inference, thereby achieving improvements in controllability. However, it takes a long period of time to develop know-how related to operations of the incinerator into fuzzy inference. Recent fuzzy control allows stabilization of combustion by regulating a feed rate of waste which can be burned in the incinerator. In contrast, it cannot cope with drastic variations (or a change for the worse; e.g., an increase in water content) in the state of the art.

SUMMARY OF THE INVENTION

The present invention has been conceived to solve the foregoing drawbacks in the prior art, and an object of the present invention is to provide a combustion system and a method of controlling the operation of the combustion system, in which stable, high-efficient and low-pollution combustion is effected by controlling a flow rate of combustion air and a feed rate of combustibles.

According to achieve the above object, a combustion system of the present invention comprises:

solid combustibles supply means;

a thermal decomposition section which generates combustible gases by thermally decomposing or partially burning the solid combustibles received from the solid combustible supply means;

a combustion section which burns the combustible gases generated by the thermal decomposition section;

first air supply means which supplies air to heating means for heating the thermal decomposition section or to the thermal decomposition section;

second air supply means which supplies air to the combustion section; and thermally-decomposed gas quality detection means for detecting the quality of the combustible gases generated in the thermal decomposition section.

The combustion system further comprises thermally-decomposed gas quantity detection means for detecting the quantity of the combustible gases generated in the thermal decomposition section or airflow rate detection means for detecting a flow rate of air supplied to the thermal decomposition section.

The combustion system further comprises thermal decomposition section temperature detection means which detects the temperature of the combustible gases developed in the thermal decomposition section.

The thermally-decomposed gas quality detection means detects a stoichiometric air-to-fuel ratio or a quasi stoichiometric air-to-fuel ratio of the combustible gases.

The stoichiometric air-to-fuel ratio or the quasi stoichiometric air-to-fuel ratio is detected by comparing to each other the magnitudes of ion currents of, or temperatures of, a plurality of premixed flames whose mixture ratio of the combustible gases to air is changed stepwise.

The plurality of premixed flames are generated substantially in alignment with the generator of an imaginary cone in such a way that they partially come into contact with each other.

A source for ignition of the premixed flames is disposed in close vicinity to the vertex of the imaginary cone.

One common electrode for detecting ion currents is provided substantially in alignment with the center axis of the imaginary cone so as to come into contact with the plurality of premixed flames. Ion currents of the respective premixed flames are measured with time lags through use of the common electrode.

The plurality of premixed flames are formed in a lower-pressure vessel rather than in the thermal decomposition section.

The solid combustibles are coals, industrial waste, municipal solid waste, polluted sludge, or a mixture thereof.

A method of controlling the operation of a combustion system of the present invention comprises the steps of:

detecting the quantity of combustible gases developed in the thermal decomposition section by means of the thermally-decomposed gas quantity detection means;

detecting a stoichiometric air-to-fuel ratio or a quasi stoichiometric air-to-fuel ratio of the combustible gases by means of the thermally-decomposed gas quality detection means; and supplying to the combustion section the quantity of air which is obtained by multiplying the product of the thus-detected quantity of combustible gases and the stoichiometric air-to-fuel ratio or quasi stoichiometric air-to-fuel ratio, by a predetermined factor by means of the second air supply means.

The operation control method further comprises the steps of:

detecting a flow rate of air supplied to the thermal decomposition section by means of the airflow rate detection means;

detecting a stoichiometric air-to-fuel ratio or quasi stoichiometric air-to-fuel ratio of the combustible gases developed in the thermal decomposition section by means of the thermally-decomposed gas quality detection means;

calculating the quantity of the combustible gases by multiplying the thus-detected flow rate of air by a predetermined factor; and supplying to the combustion section the quantity of air which is obtained by multiplying the product of the quantity of combustible gases and the stoichiometric air-to-fuel ratio or quasi stoichiometric air-to-fuel ratio, by a predetermined factor by means of the second air supply means.

The operation control method further comprises the steps of:

detecting the temperature of the combustible gases developed in the thermal decomposition section by means of the thermal decomposition section temperature detection means;

detecting a stoichiometric air-to-fuel ratio or quasi stoichiometric air-to-fuel ratio of the combustible gases developed in the thermal decomposition section by means of the thermally-decomposed gas quality detection means; and changing at least either the feed rate of the solid combustibles by means of the solid combustibles supply means or the feed rate of air by the first air supply means, on the basis of variations in the thus-detected temperature of the combustible gases and in the stoichiometric air-to-fuel ratio or quasi stoichiometric air-to-fuel ratio of the combustible gases.

The operation control method further comprises the steps of:

detecting the temperature of the combustible gases developed in the thermal decomposition section by means of the thermal decomposition section temperature detection means;

detecting a stoichiometric air-to-fuel ratio or quasi stoichiometric air-to-fuel ratio of the combustible gases developed in the thermal decomposition section by means of the thermally-decomposed gas quality detection means; and changing at least either the feed rate of the solid combustibles by means of the solid combustible supply means or a heating rate of heating means, on the basis of variations in the thus-detected temperature of the combustible gases and in the stoichiometric air-to-fuel ratio or quasi stoichiometric air-to-fuel ratio of the combustible gases.

The above and other objects and features of the present invention will be more apparent from the following description taken in conjunction with the accompanying drawings.

BRIEF DESCRIPTION OF THE DRAWINGS

In the drawings:

FIGS. 7A and 7B are schematic representations of thermally-decomposed gas quality detection means according to a sixth embodiment of the present invention, in which FIG. 7A is a top view of an ion current detection electrode, and FIG. 7B is a cross-sectional view of the overall structure of the the thermally-decomposed gas quality detection means;

DETAILED DESCRIPTION OF THE PREFERRED EMBODIMENTS

Now, a description will be given in more detail of preferred embodiments of the present invention with reference to the accompanying drawings.

FIRST EMBODIMENT

Figure 1:
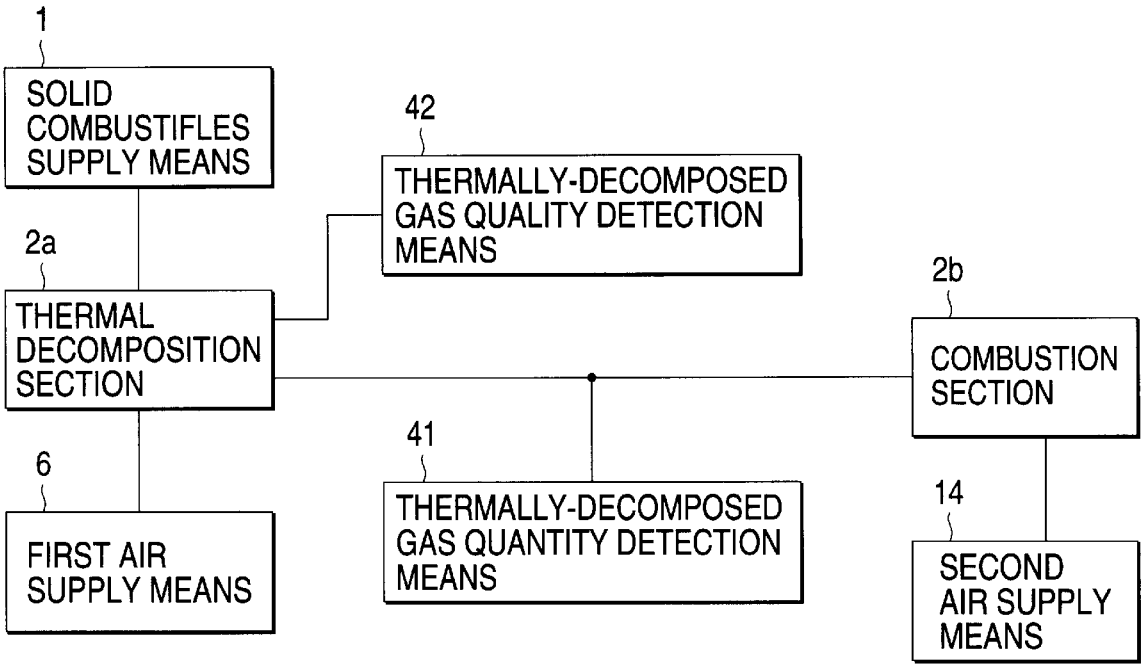
FIG. 1 is a block diagram illustrating the structure of a combustion apparatus according to a first embodiment of the present invention.

FIG. 1 is a block diagram for illustrating the structure of a combustion system according to a first embodiment of the present invention. In the drawing, reference numeral 1 designates a solid combustibles supply means; 2*a* designates a thermal decomposition section for thermally decomposing or partially burning solid combustibles received from the solid combustibles supply means 1; 2*b* designates a combustion section for burning combustible gases (hereinafter referred to as "thermally-decomposed gases") developed in the thermal decomposition section 2*a*; 6 designates first air supply means for supplying air for partial combustion purposes to the thermal decomposition section 2*a*; and 14 designates second air supply means for supplying air for combustion purposes to the combustion section 2*b*.

Figure 12:
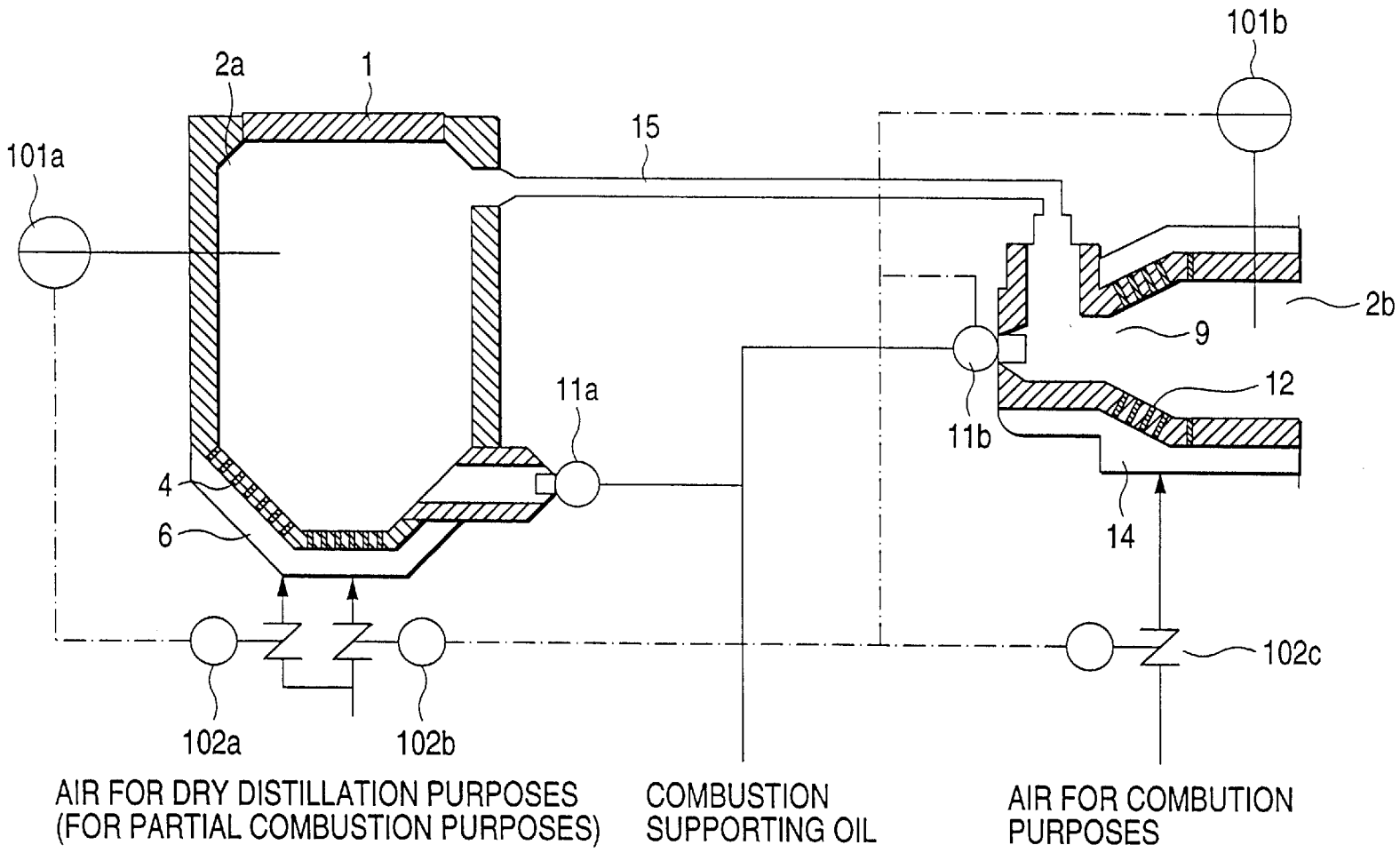
FIG. 12 PRIOR ART
FIG. 12 is a cross-sectional view illustrating the structure of a conventional gasifying combustion incinerator.
Figure 13:
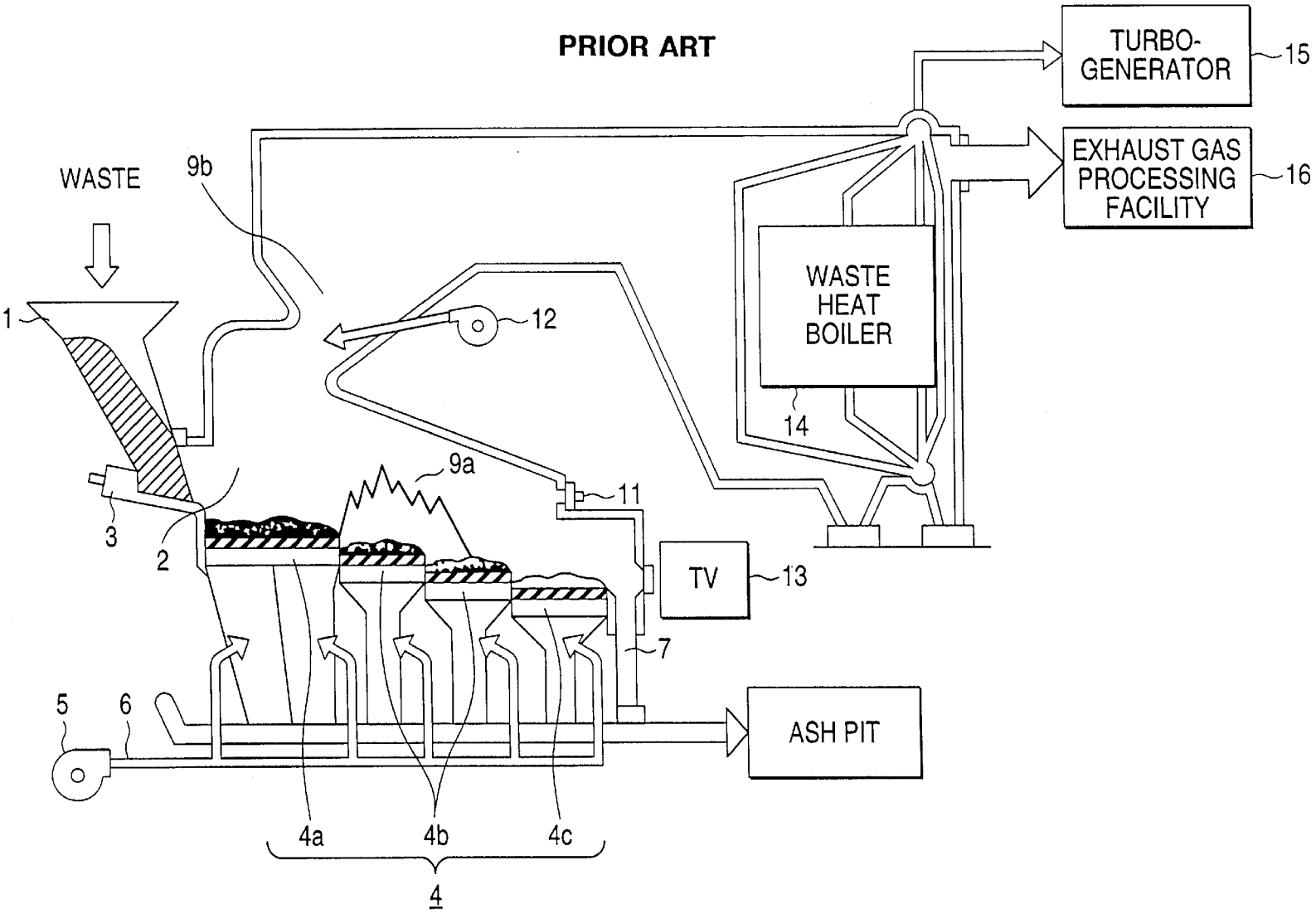
FIG. 13 PRIOR ART
FIG. 13 is a cross-sectional view illustrating the structure of a conventional stoked fire furnace.
Figure 14:
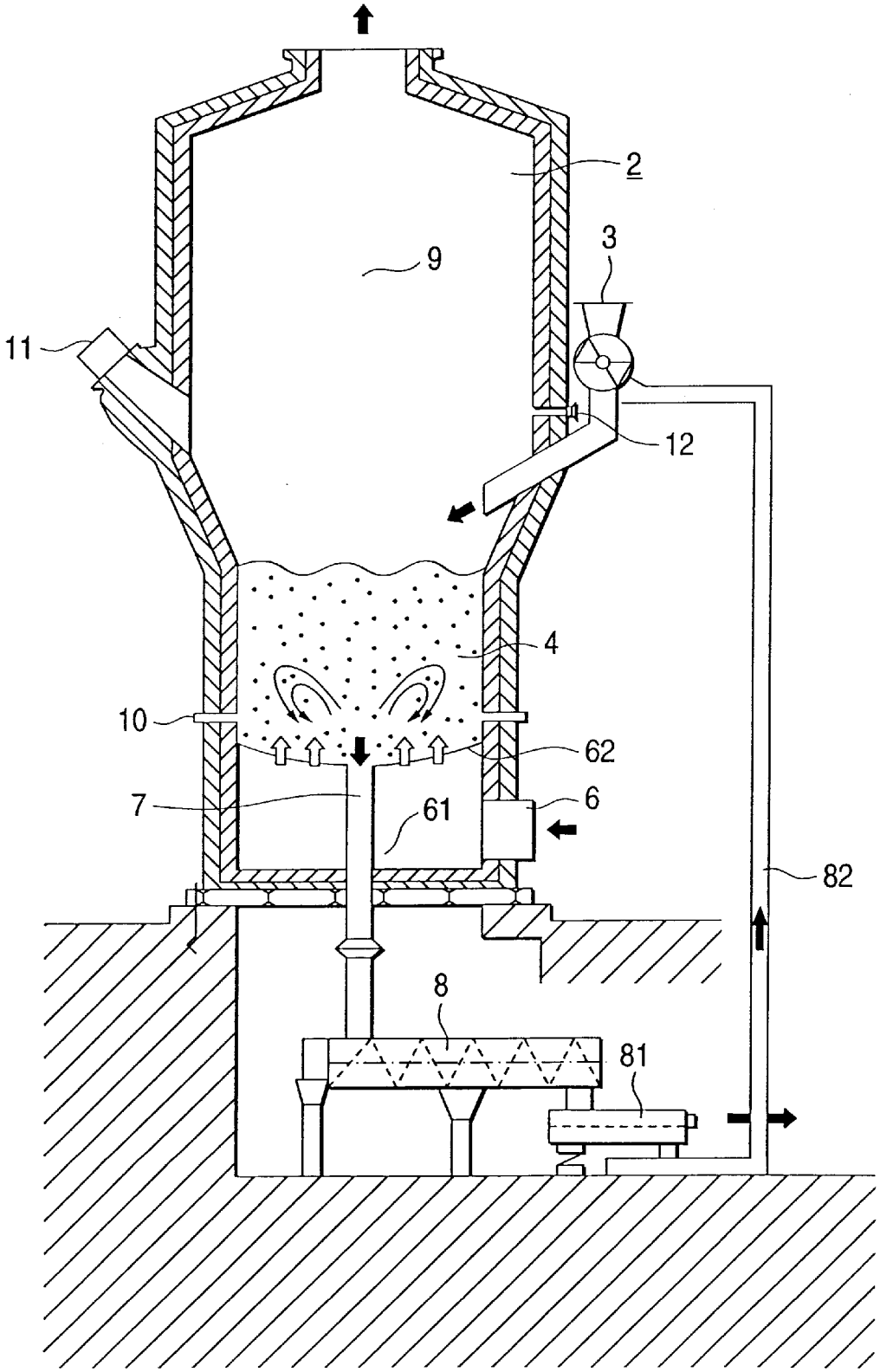
FIG. 14 PRIOR ART
FIG. 14 is a cross-sectional view illustrating the structure of a conventional fluidized bed furnace.

With regard to the specific structure of the combustion system, for example, the gasifying combustion incinerator that is illustrated in FIG. 12 and is used when describing the conventional incinerator is employed. The stoker fired furnace illustrated in FIG. 13 can be also used, provided that the vicinity of the boundary between the drying stoker 4*a* and the burning stoker 4*b* corresponds to the thermal decomposition section 2*a*, and the burning stoker 4*b* corresponds to the combustion section 2*b*. Moreover, the fluidized bed furnace illustrated in FIG. 14 can be adopted, provided that the fluidized bed 4 which receives fluidized air supply doubling as primary air corresponds to the thermal decomposition section 2*a*, and the freeboard 9 which receives secondary air corresponds to the combustion section 2*b*.

Reference numeral 41 designates thermally-decomposed gas quantity detection means which communicates with the thermal decomposition section 2*a* and with the combustion section 2*b* and measures the quantity of thermally-decomposed gases developed in the thermal decomposition section 2*a*. For example, the thermally-decomposed gas quantity detection means 41 is a flow meter provided in the thermally-decomposed gas flow channel 15 illustrated in FIG. 12. Reference numeral 42 designates thermally-decomposed gas quality detection means which communicates with the thermal decomposition section 2a and detects the quality of the thermally-decomposed gases developed in the thermal decomposition section 2*a* by partially extracting them. The structure and operation of the thermally-decomposed gas quality detection means 42 will be described in detail later.

Next, the operation of the combustion system will be described. A predetermined quantity of solid combustibles is fed to the thermal decomposition section 2*a* by the solid combustibles supply means 1, and the first air supply means 6 supplies air for partial combustion purposes to the thermal decomposition section 2*a*. A starting burner (not shown) ignites the solid combustibles, thereby commencing thermal decomposition and partial combustion of the combustibles. Subsequently, the combustion changes to steady combustion. At this time, only the quantity of combustion air required to incompletely burn the combustibles is supplied to the thermal decomposition section 2*a*. As a result, combustible gases (referred to herein as thermally-decomposed gases) are generated, and the thus-generated gases are supplied to the combustion section 2*b*. During the course of their travel to the combustion section 2*b*, the flow meter serving as the thermally-decomposed gas quantity detection means measures the quantity of the gases. The thermally-decomposed gas quality detection means 42 detects the quality of the thermally-decomposed gases developed in the thermal decomposition section 2*a* by extracting a portion of the gases. On the basis of the thus-detected quantity and quality data, the second air supply means 14 supplies a predetermined quantity of combustion air to the combustion section 2*b* such that an excess air ratio previously determined by the combustion section 2*b* is achieved. Then, the thermally-decomposed gases are completed burned in the combustion section 2*b*.

Figure 2A:
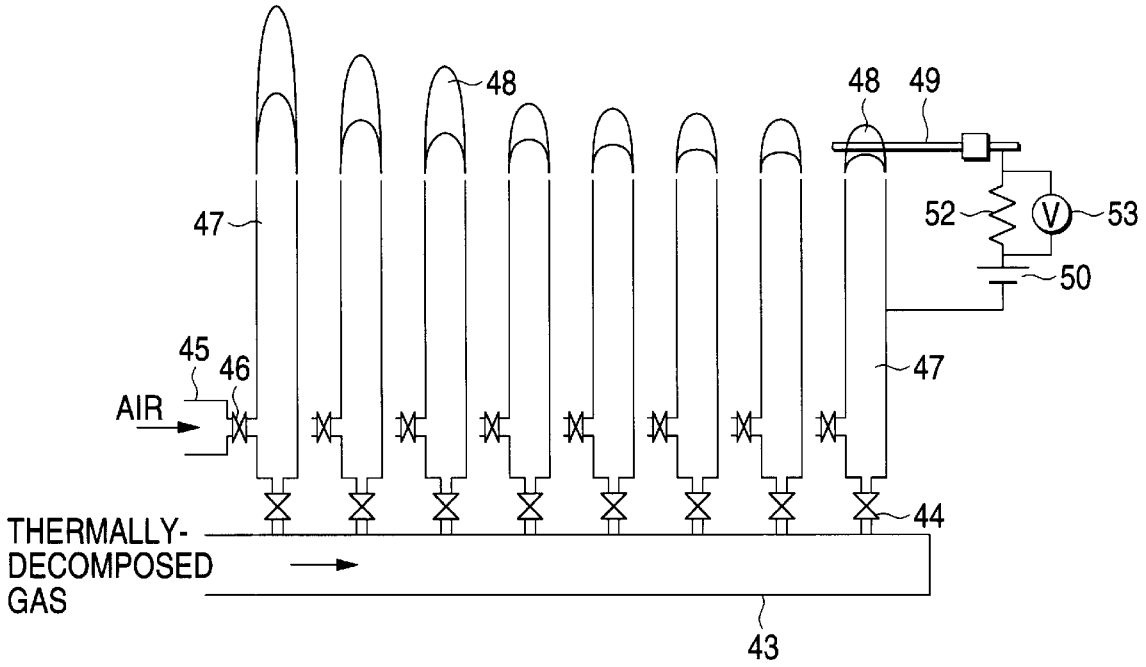
FIG. 2A is a schematic representation of the structure of thermally-decomposed gas quality detection means of the first embodiment of the present invention.

Next, with reference to the drawings, one example of the thermally-decomposed gas quality detection means will be described. In FIG. 2A, reference numeral 43 designates a thermally decomposed gas manifold which is provided so as to communicate with; e.g., the thermally-decomposed gas flow channel 15 illustrated in FIG. 12. Reference numeral 44 designates thermally-decomposed gas flow rate control valves disposed downstream from the thermally decomposed gas manifold 43; 45 designates an air manifold; 46 designates air flow rate control valves disposed downstream from the air manifold 45; 47 designates a plurality of pilot burners for burning a premixed gaseous mixture consisting of the thermally-decomposed gases and air; 48 designates premixed flames formed at the front end of the pilot burners 47; 49 designates ion current detection electrodes which are provided for the respective pilot burners 47 and are to be inserted into the respective premixed flames 48; 50 designates power sources used for detecting ion currents; and 52 designates ion current detection resistors which are connected to the ion current detection electrodes and are set to the same value.

A closed circuit is formed from the pilot burner 47, the premixed flame 48, the ion current detection electrode 49, the resistor 52, and the power source 50. The closed circuit is provided for each of the pilot burners 47 (only one of them is illustrated at the right hand side of the drawing in FIG. 2A). Reference numeral 53 designates potentiometers used for detecting ion currents.

The operation of the thermally-decomposed gas quality detection means will be described. After the thermally-decomposed gas has been introduced into the thermally-decomposed gas manifold 43, the flow rate control valves 44 respectively regulate the thermally-decomposed gases such that a predetermined flow rate of thermally-decomposed gases is supplied to the respective pilot burners 47. With regard to air, after air has been introduced to the air manifold 45, the air flow rate control valves 46 regulate the air such that a predetermined flow rate of air is supplied to the respective pilot burners 47. At this time, a mixture ratio of the thermally-decomposed gases to air is changed for each pilot burner 47 and is set stepwise from the insufficient quantity of air through an excessive quantity of air in terms of the quantity of air required for complete combustion. The premixed gaseous mixture supplied to the respective pilot burners 47 is ignited at the front end of the respective pilot burners 47, whereby the premixed flames 48 are formed.

Figure 2B:
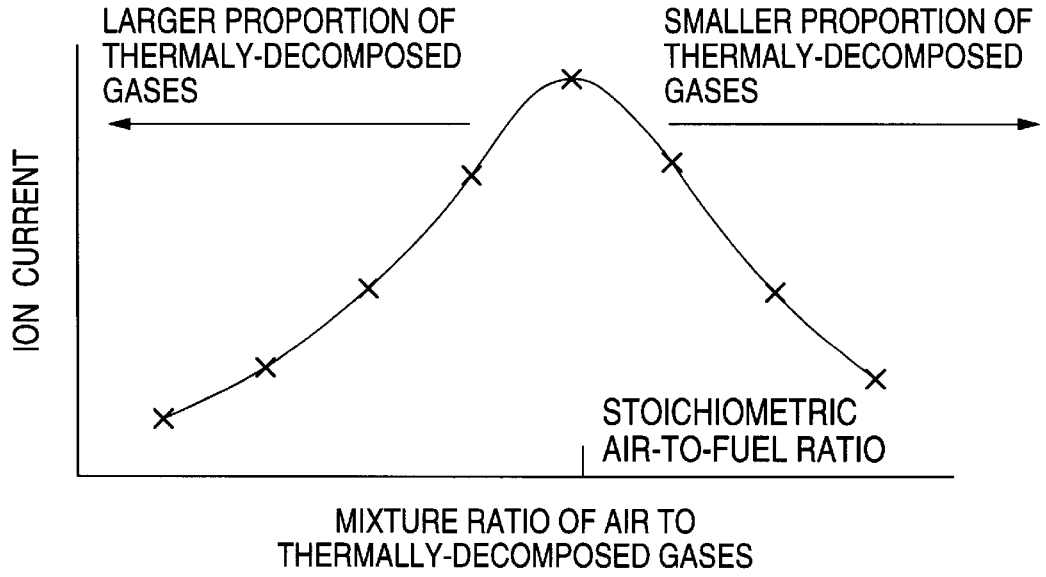
FIG. 2B is a plot illustrating the operation of the thermally-decomposed gas quality detection means illustrated in FIG. 2A.

The ion current detection electrodes 49 are inserted into the respective premixed flames 48, and a closed circuit is formed from the pilot burner 47, the premixed flame 48, the ion current detection electrode 49, and the resistor 52. Since reactive free radicals exist in the premixed flames 48, the premixed flames 48 have electrical conductivity. The electrical conductivity varies with a mixture ratio of fuel to air (i.e., the excess air ratio). In general, if there is the minimum quantity of air supply required for complete combustion (i.e., the stoichiometric air), or if there is a slightly insufficient air supply compared to the minimum required quantity of air, the electrical conductivity of the premixed flame 48 becomes maximum. This is illustrated in FIG. 2B. The horizontal axis of the plot in FIG. 2B represents the mixture ratio of the thermally-decomposed gases to air that varies from pilot burner 47 to pilot burner 47. The mixture ratio is set stepwise over a wide range in such a way that there are a shortage of air and an excess of air with reference to the minimum quantity of air required to completely burn the thermally-decomposed gases (i.e., the mixture ratio set at this time corresponds a stoichiometric air-to-fuel ratio). As a result, any one of the potentiometers 53 detects the maximum voltage because of the previously-described reasons. The ion current is obtained by dividing the voltage measured by the potentiometer 53 by the resistance of the ion current detection resistor 52. The resistance of the ion current detection resistor 52 is set in the region of tens of kilo ohms which is sufficiently smaller than an electrical resistance of several megohms of the premixed flame 48, and all of the closed circuits employ the same resistance.

Even if there are variations in the quality of combustibles and in the composition of the thermally-decomposed gases, and the previous characteristics are still maintained. Therefore, a peak value is usually detected at the stoichiometric air-to-fuel ratio of the thermally-decomposed gases, or at the excess air ratio that is slightly smaller than it (quasi stoichiometric air to fuel ratio), at each moment in time. Combustion air is supplied to the combustion section 2*b* on the basis of the stoichiometric air-to-fuel ratio or quasi stoichiometric air-to-fuel ratio, in such a way that a predetermined excess air ratio is achieved.

Next, the previously-described method of controlling the operation of the combustion system will be described in a more detailed manner. For example, a commercially available common ultrasonic flow meter is used as the thermally-decomposed gas quantity detection means thereby to obtain a volumetric flow rate $Q_{gas}$ of the thermally-decomposed gases. Further, the stoichiometric air-to-fuel ratio $\lambda_{st}$ of the thermally-decomposed gases can be obtained by an ion current stoichiometric air-to-fuel detector which is described as thermally-decomposed gas quality detection means previously. The stoichiometric air of the thermally-decomposed gases can be obtained by use of the product of the volumetric flow rate and the stoichiometric air-to-fuel ratio; namely, $Q_{gas}\lambda_{st}$.

In the combustion apparatus illustrated in FIG. 1, the combustibles are partially burned (or thermally decomposed) through use of the primary air supplied to the thermal decomposition section 2*a*, and the thermally-decomposed gases are completely burned by introduction of secondary air into the combustion section 2*b*. At this time, the relationship between the excess air ratio $\lambda_2$ [$=Q_{a2}/(Q_{gas}\lambda_{st})$] of the secondary air (the quantity of air $Q_{a2}$) to be supplied to the combustion section 2*b* and the concentration of CO in the exhaust gas forms a parabola shape which opens upwards. The concentration of CO in the exhaust gas becomes minimum at a certain excess air ratio $\lambda_2$ of the secondary air. The value of excess air ratio of the secondary air varies according to the structure of a secondary air inlet for the combustion section 2*b*. The excess air ratio is slightly smaller than unity approximately, and the sum of the excess air ratios of the thermal decomposition section 2*a* and the combustion section 2*b* is set from about 1.6 to 2.0 approximately. The quantity of secondary air to minimize the concentration of CO in the exhaust gas can be calculated by multiplying the previously-obtained stoichiometric air ($Q_{gas}\lambda_{st}$) of the thermally-decomposed gases by the appropriate excess air ratio of the secondary air according to the structure of the secondary air inlet.

The quantity of secondary air mentioned above is supplied to the combustion section 2*b*.

As described above, in the first embodiment, the thermally-decomposed gas quality detection means 42 detects in real time the quality of the thermally-decomposed gases developed in the thermal decomposition section 2*a*; i.e., the stoichliometric air-to-fuel ratio or quasi stoichiometric air-to-fuel ratio of the thermally-decomposed gases. Therefore, combustion air corresponding to the quality and quantity of the thermally-decomposed gases can be supplied to the combustion section 2*a*, and stable combustion can be always ensured even if there are variations in the quality and quantity of thermally-decomposed gases. As a result, highly-efficient and low-pollution combustion and stable operations of a section of the system subjected to thermal load can be implemented.

SECOND EMBODIMENT

A combustion system of a second embodiment measures the quantity of air to be supplied to the thermal decomposition section 2*b* (i.e., the quantity of primary air) without particular use of the thermally-decomposed gas quantity detection means 41, as was the case with the first embodiment. The quantity of thermally-decomposed gases may be estimated by multiplying the thus-measured quantity of primary air by a previously experimentally calculated ratio of the quantity of thermally-decomposed gases to the quantity of primary air; i.e., (the quantity of thermally-decomposed gases)/(the quantity of primary air). The omission of the thermally-decomposed gas detection means 41 from the combustion system renders the combustion system inexpensive. In other respects, the combustion system of the second embodiment is the same in structure as that of the first embodiment.

Although a specific numerical value of the ratio (the quantity of thermally-decomposed gases)/(the quantity of primary air) varies according to the quality of combustibles and with the temperature of thermal decomposition, it is approximately about 1.2.

THIRD EMBODIMENT

Figure 3:
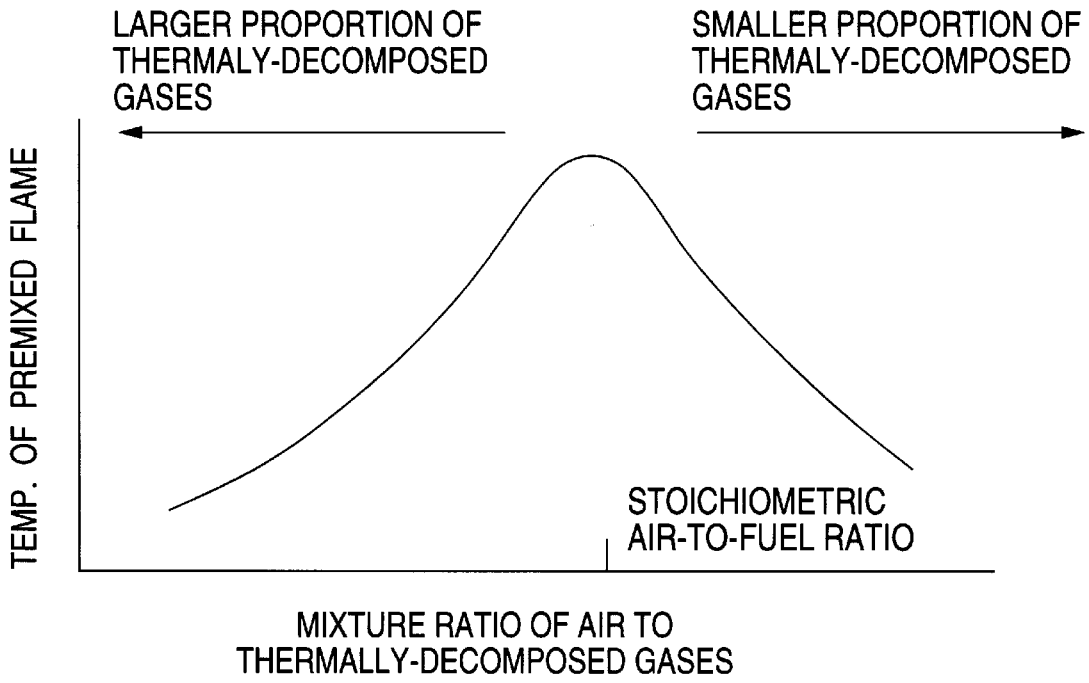
FIG. 3 is a plot illustrating the operation of one example of thermally-decomposed gas quality detection means according to a third embodiment of the present invention.

The ion current values of the plurality of pilot burners 47 are compared with each other in order to obtain the stoichiometric air-to-fuel ratio or quasi stoichiometric air-to-fuel ratio in the first embodiment. The temperatures of the respective premixed flames 48 may be compared with each other through use of; e.g., thermocouples, in lieu of the ion current detection electrodes 49. The relationship between the temperature of the premixed flames and the excess air ratio is the same as the relationship between the ion current and the excess air ratio. As illustrated in FIG. 3, there is a peak in the vicinity of the stoichiometric air-to-fuel ratio. As a result, it is possible to know the stoichiometric air-to-fuel ratio or quasi stoichiometric air-to-fuel ratio of the thermally-decomposed gases during the course of operation of the combustion system at each moment in time, which enables the operation of the combustion apparatus at a preset excess air ratio.

Figure 4:
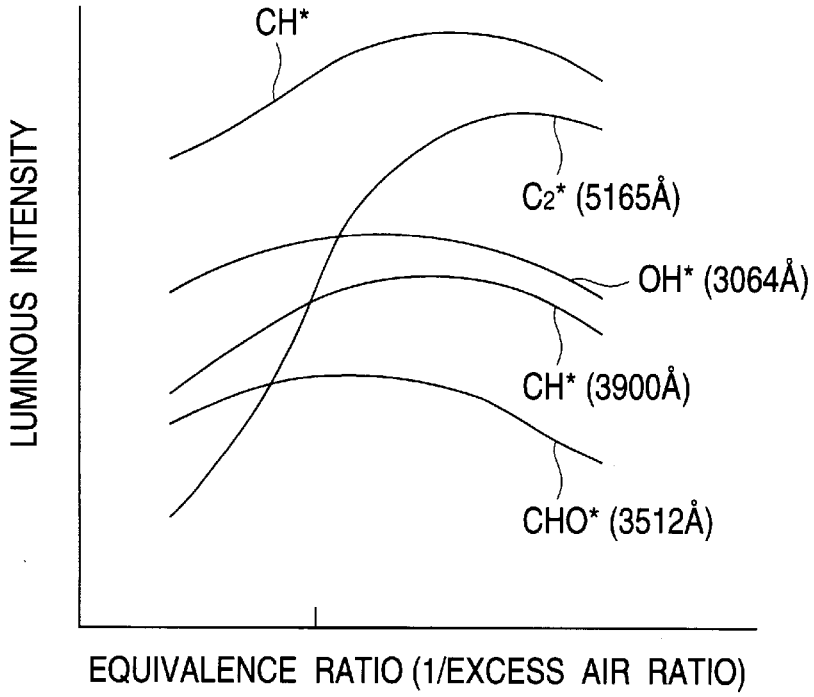
FIG. 4 is a plot illustrating the operation of another example of the thermally-decomposed gas quality detection means of the third embodiment.

The characteristic of free radicals present in the flames; e.g., the relationship between the luminous intensity of light emitted from OH* or CHO* and an excess air ratio (shown in FIG. 4), is the same as the relationship between the ion current and the temperature of flames. It is also possible to ascertain the stoichiometric air-to-fuel ratio or quasi stoichiometric air-to-fuel ratio of the thermally-decomposed gases during the course of operation of the combustion system at each moment in time, which enables the operation of the combustion apparatus at a preset excess air ratio.

FOURTH EMBODIMENT

Figure 5:
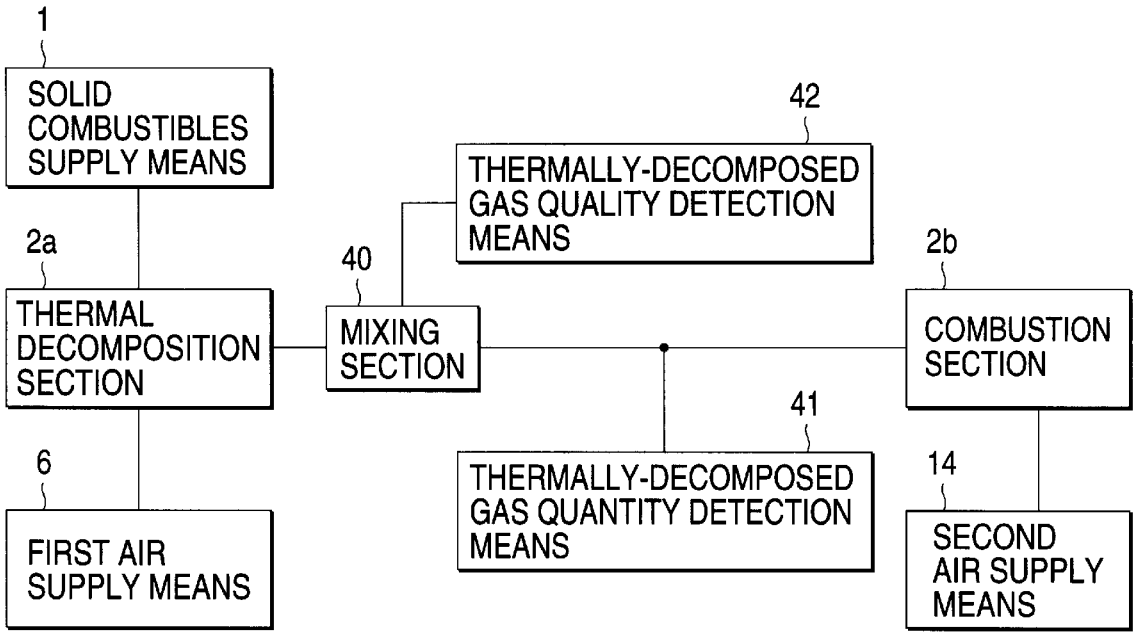
FIG. 5 is a block diagram illustrating the structure of a combustion apparatus according to a fourth embodiment of the present invention.

FIG. 5 is a block diagram illustrating the structure of a combustion system according to a fourth embodiment of the present invention. In the drawing, reference numeral 40 designates a mixing section which communicates with the thermal decomposition section 2*a*, with the thermally-decomposed gas quantity detection means 41, and with the thermally-decomposed gas quality detection means 42. In other respects, the combustion system is the same in structure as that illustrated in FIG. 1. One illustrative example of the mixing section 40 is constructed so as to promote turbulent mixture of the thermally-decomposed gases by swirling the stream of the thermally-decomposed gases in the same way as is carried out by e.g., air-guide vanes (e.g., a swirler) of a gas turbine combustion apparatus. In the example illustrated in FIG. 12, the mixing section 40 is provided at the entrance of the thermally-decomposed gas flow channel 15.

In the combustion apparatus having the foregoing structure, the mixture of the thermally-decomposed gases is promoted by the mixing section 43, and the quality of the thermally-decomposed gases becomes uniform. As a result, the detection of the quality of the thermally-decomposed gases is carried out more precisely.

FIFTH EMBODIMENT

Figure 6:
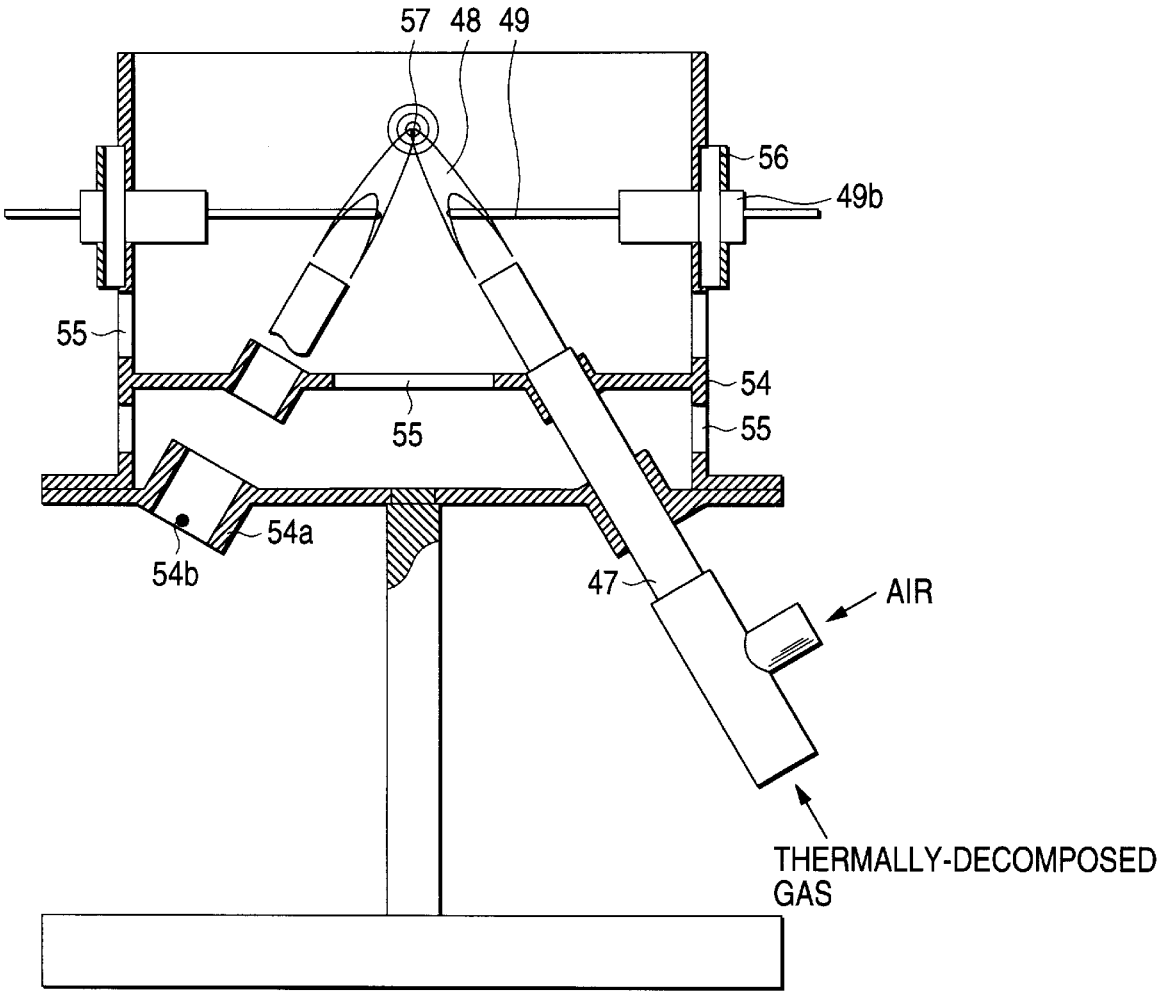
FIG. 6 is a schematic representation of thermally-decomposed gas quality detection means according to a fifth embodiment of the present invention.

FIG. 6 is a schematic representation illustrating the structure of thermally-decomposed gas quality detection means employed in a fifth embodiment of the present invention. In the drawing, reference numeral 54 designates a pilot burner fixing member for holding the plurality of pilot burners 47 substantially in alignment with the generator of an imaginary cone. The pilot burners 47 inserted into cylindrical metal fixtures 54*a* are fastened with screws 54*b*. Reference numeral 55 designates a combustion air vent for pilot burners; 49*b* designates an electrical insulator for electrically insulating the ion current detection electrode 49 from the pilot burner fixing member 54; and 56 designates a metal fixture for fastening the electrical insulator 49*b* of the ion current detection electrode 49 to the pilot burner fixing member 54. The plurality of pilot burners 47 are arranged substantially in alignment with the generator of an imaginary cone in such a way that the premixed flames 48 formed at the front ends of the respective pilot burners 47 come into close proximity to each other. Reference numeral 57 designates a source of ignition disposed in the vicinity of the vertex of the imaginary cone; namely, an ignition plug. For example, the source of ignition 57 is comprised of a total of two electrodes which are disposed opposite to each other in a peripheral direction with a gap of 3 to 4 mm between the front ends of the electrodes, and a high-voltage electrical discharge occurs across the gap.

The operation of the thermally-decomposed gas quality detection means will be described. The thermally-decomposed gas quality detection means operates in principle in the same way as does in the first embodiment. Since the plurality of pilot burners 47 are arranged in substantially alignment with the generator of the imaginary cone in such a way that the front ends of the pilot burners 47 come into close proximity to each other, and the premixed flames 48 are brought into close proximity to each other. Even if any of the premixed flames 48 is extinguished, the other premixed flames 48 keeps burning continuously. If the excess air ratio of the-premixed gaseous mixture in each of the pilot burners 47 which have been in an extinguished state by that time enters a combustible range, the premixed gaseous mixture is ignited by the other flames 48, thereby rekindling the premixed flames 48.

As described above, even if any flame of the pilot burners 47 has gone out, the pilot burners 47 as a whole are kept in a burning state at all times. Further, the combustion system requires only one source of ignition 57.

SIXTH EMBODIMENT

Figure 7A:
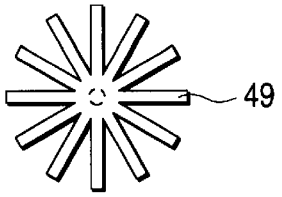
Figure 7B:
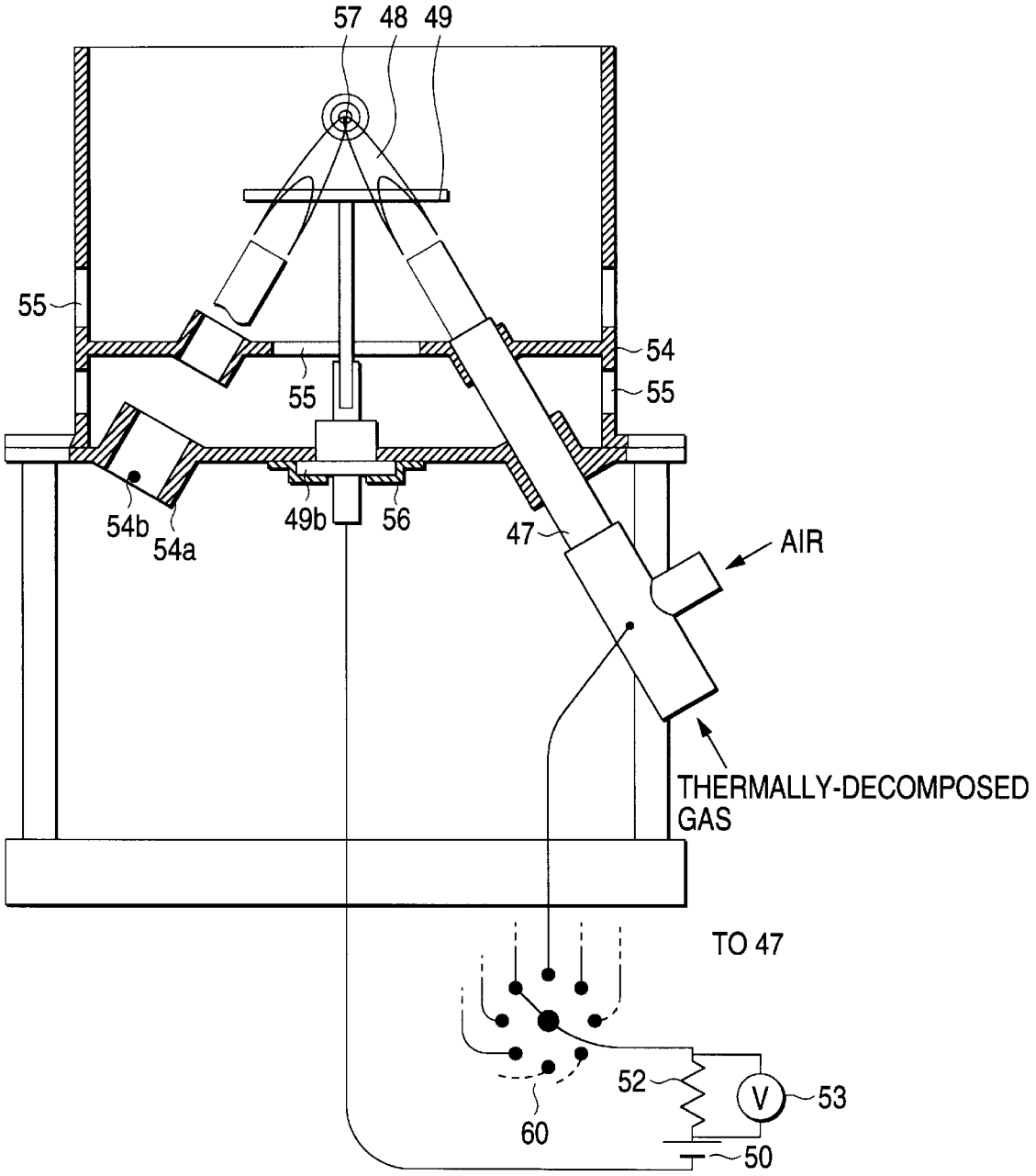

FIGS. 7A and 7B are schematic representations of the structure of thermally-decomposed gas quality detection means according to a sixth embodiment of the present invention. FIG. 7B is a cross-sectional view of the overall structure of the thermally-decomposed gas quality detection means, and FIG. 7A is a top view of the ion current detection electrode 49. As illustrated in the drawings, one ion current detection electrode 49 is disposed substantially in alignment with the center axis of the imaginary cone so as to come into contact with the plurality of premixed flames 48. As illustrated in FIG. 7A, electrodes radially extend toward the premixed flames from the center of the ion current detection electrode 49 in the sixth embodiment. The pilot burners 47 are electrically isolated from the pilot burner fixing members 54. The ion current detection electrode 49 is electrically isolated from the pilot burner fixing members 54, as is the case with the thermally-decomposed gas quality detection means illustrated in FIG. 6. Reference numeral 60 designates a scanner which is at one end thereof electrically connected to an ion current detection resistor 52 and is at a plurality of other ends thereof electrically connected to the pilot burners 47 (only one of the ends is connected to the pilot burner 47 by a solid line, and the connection of the other ends to the pilot burners is indicated by a broken line in the drawing).

Next, the operation of the thermally-decomposed gas quality detection means will be described. The basic method of measuring the premixed flames 48 is the same as that used in the first and fifth embodiments. In the sixth embodiment, provided that one ion current detection electrode 49 is in contact with the premixed flames 48, the magnitude of ion currents of each of the premixed flames 48 is measured one at a time through use of the scanner 60 with very short time lags (e.g., 10 msec) while the respective pilot burners 47 are electrically connected to the ion current measurement resistor 52.

The ion current is measured a number of times in order to average the variations in the ion current over time, and a mean value of the thus-measured values of each pilot burner 47 is used as an ion current value of that pilot burner 47.

SEVENTH EMBODIMENT

Figure 8:
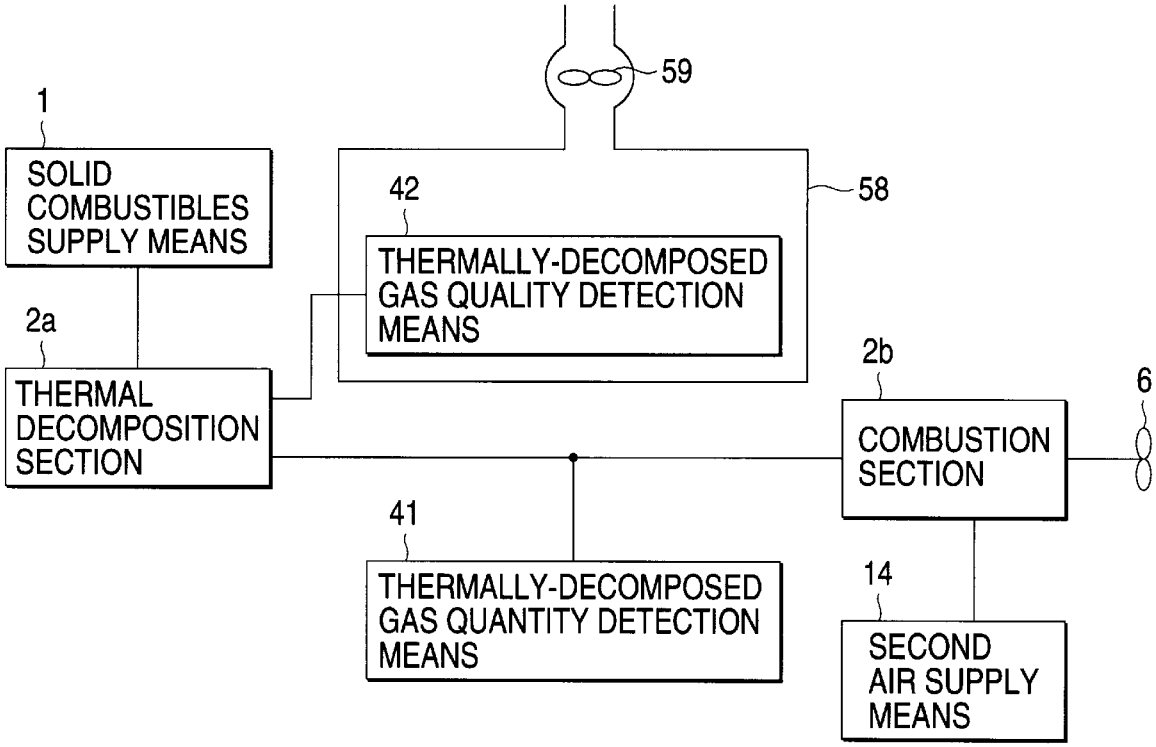
FIG. 8 is a block diagram illustrating the structure of a combustion apparatus according to a seventh embodiment of the present invention.

FIG. 8 is a block diagram illustrating the structure of a combustion system according to a seventh embodiment of the present invention. In the drawing, reference numeral 58 designates a low-pressure container, or a housing case; and 59 designates an exhaust fan attached to the housing case 58. Reference numeral 6 designates a gas duct fan which communicates with the combustion section 2*b* and aspirates and discharges combustion gas therefrom. This gas duct fan 6 corresponds to the first air supply means.

This combustion system operates in the following manner. In the combustion system, the combustion air introduced into the thermal decomposition section 2*a* is aspirated by the gas duct fan 6. For a large-scale municipal solid waste incinerator, it is common to set the internal pressure of the incinerator lower than the atmospheric pressure so as to prevent dispersion of a foul odor around the incinerator. In this case, there are two ways to introduce the thermally-decomposed gases produced in the thermal decomposition section 2*a* into the thermally-decomposed gas quality detection means 42. The first way is a method of providing a blower between the thermal decomposition section 2*a* and the thermally-decomposed gas quality detection means 42, and the second way is a method of providing a blower downstream from the thermally-decomposed gas quality detection means 42. Since thermally-decomposed hot gases directly flow through the blower, the former method is not desirable in view of heat resistance and durability. In contrast, in the case of the latter method, the entire thermally-decomposed gas quality detection means 42 is housed in a case 58, and the burned gas produced on the pilot burners is exhausted from the case 58 by the exhaust fan 59. As a result, the thermally-decomposed gas quality detection means 42 is held at a pressure lower than the pressure at which the thermal decomposition section 2*a* is held. The thermally-decomposed gases are introduced into the thermally-decomposed gas quality detection means 42 by generation of a lower pressure. If a large quantity of combustion air for use with the pilot burners 47 is also aspirated from the surroundings at this time, combustion gas generated by the premixed flames 48 are sufficiently diluted, and hence the temperature of the combustion gas to be exhausted through the blower 59 is sufficiently reduced, in turn preventing adverse effects on the blower 59.

The thermally-decomposed gas quality detection device that is the same as those used in the previous embodiments is used as the thermally-decomposed gas quality detection means 42 in the seventh embodiment. It is only necessary for the low-pressure container 58 to house at least a premixed flame generation section, or the pilot burners 47. Detection sections (e.g., the ion current detection power source 50, the ion current detection resistor 52, the ion current detection potentiometer 53, etc., in the case of an ion current detection section) may be disposed outside the low-pressure container 58.

A flow rate of the thermally-decomposed gases is regulated so as to be a predetermined flow rate by the thermally-decomposed gas flow control valve 44, and a flow rate of air is regulated so as to be a predetermined flow rate by the air flow control valve 46.

In the embodiments illustrated in FIGS. 2 to 4, 6, and 7, comparisons of ion currents are drawn between the plurality of premixed flames 48 while the mixture ratio of thermally-decomposed gases and air is changed for each pilot burner 47. Alternatively, the mixture ratio of thermally-decomposed gases to air may be changed for one pilot burner 47 with time.

EIGHTH EMBODIMENT

A combustion system of an eight embodiment of the present invention is provided with; e.g., means for detecting the temperature of combustible gases, or thermally-decomposed gases, developed in the thermal decomposition section 2*a* illustrated in FIG. 1. A thermocouple is used as the thermally-decomposed gas temperature detection means, as is the case with the temperature sensor 101a illustrated in FIG. 12.

Figure 9:
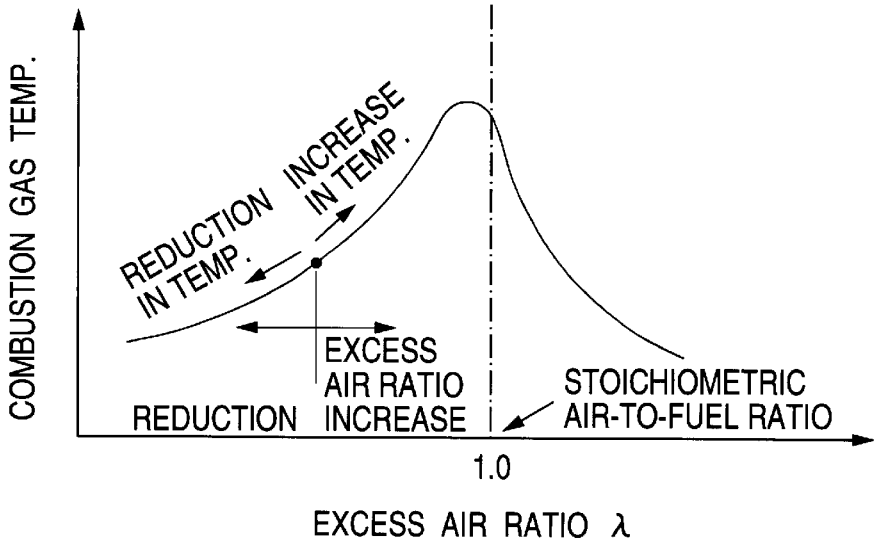
FIG. 9 is a plot illustrating the general relationship between an excess air ratio and the temperature of combustion air according to an eighth embodiment of the present invention.

In a case where a gaseous fuel or liquid fuel having uniform nature is used, the relationship between an excess air ratio and the temperature of the combustion gas generally exhibits the highest temperature in the vicinity of the stoichiometric air-to-fuel ratio as illustrated in FIG. 9. If the range of excess air ratio is limited to a smaller area (e.g., the area on the left side of the peak) with reference to the stoichiometric air-to-fuel ratio, a reduction in the temperature of the combustion gas means a reduction in the excess air ratio. Conversely, an increase in the temperature of the combustion gas means an increase in the excess air ratio.

Even if the fuel is exchanged with waste, the relationship between the temperature of the combustible gases in the thermal decomposition section 2*a* (hereinafter referred to as the temperature of the thermal decomposition section) and the excess air ratio is alike, so long as the nature of the waste is uniform. In short, the reduction in the temperature of the thermal decomposition section means the reduction in an operation air excess ratio, whereas an increase in the temperature means an increase in the operation air excess ratio.

Based on the previous descriptions, the way to control the operation of the combustion system of the eight embodiment will be specifically described with regard to the following four cases presented in Table 1.

TABLE 1

| | Temp. of a thermal decomposition section | Ratio of (the quantity of air to be mixed)/(the quantity of therma11y-decomposed gases) which produces a peak ion current value |
|---|---|---|
| A | Decrease | Increases (an increase in a proportion of combustible thermally-decomposed gases) |
| B | Increase | Decrease (a decrease in the proportion of combustible components in the thermally-decomposed gases) |
| C | Decrease | Decrease (a decrease in the proportion of combustible components in the thermally-decomposed gases) |
| D | Increase | Increase (an increase in the proportion of combustible components in the thermally-decomposed gases) |

Figure 10:
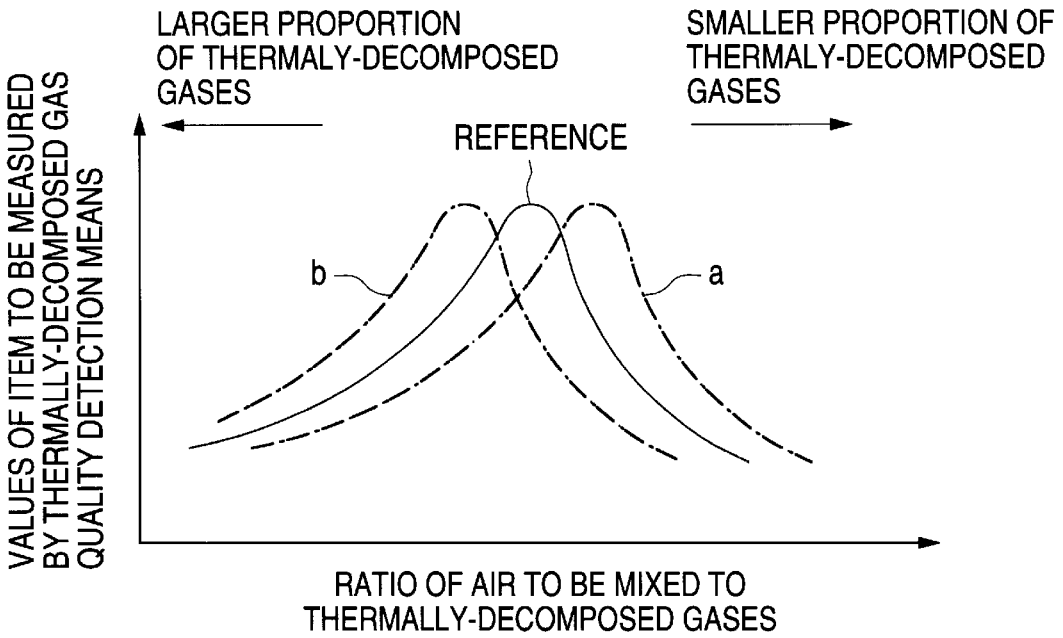
FIG. 10 is a plot illustrating an example of variations in the values measured by thermally-decomposed gas quality detection means of the eighth embodiment.

For the item A in Table 1; namely, in the case where the temperature of the thermal decomposition section 2*a* decreases with reference to its preset temperature, and where there is an increase in the ratio of the quantity of air to be mixed to the quantity of thermally-decomposed gases that has a peak in the item (e.g., an ion current value) to be measured by the thermally-decomposed gas quality detection means; or there is a decrease in the proportion of the thermally-decomposed gases (designated by a curve "a" in FIG. 10), the quantity of supply of combustibles is reduced. The quantity of loading of combustibles is returned to the original quantity, when or slightly before the time at which the temperature of the thermal decomposition section 2*a* has returned to the preset temperature.

The thermal decomposition section 2*a* is usually operated at an excess air ratio smaller than a stoichiometric air-to-fuel ratio (the same applies to the respective items B through D). As illustrated in FIG. 9, from the reduction in the temperature of the combustion gas in the thermal decomposition section 2*a* with reference to its preset temperature, it is expected that there would have been a reduction in the excess air ratio of the thermal decomposition section 2*a*; namely, an increase in the proportion of combustible components in the thermally-decomposed gases.

In contrast, an increase in the ratio of the quantity of air to be mixed to the quantity of thermally-decomposed gases (which is proportional to the air excess ratio) that has a peak in the value to be measured by the thermally-decomposed gas detection, means a reduction in the proportion of the thermally-decomposed gases. The fact that the quantity of thermally-decomposed gases has decreased when compared to the quantity of air to be mixed, means an increase in the proportion of combustible components in the thermally-decomposed gases. This agrees with the expectation based on the variations in the temperature illustrated in FIG. 9. In short, the previous fact means that the quantity of supplied solid combustibles has increased if a constant quantity of air is supplied to the thermal decomposition section 2*a*.

In this case, the quantity of feed of solid combustibles is decreased, and the excess air ratio in the thermal decomposition section 2*a* is increased so as to increase the temperature of the thermal decomposition section 2*a*. When or slightly before the time at which the temperature of the thermal decomposition section has returned to the preset temperature, the quantity of loading of combustibles is returned to the original quantity.

Next, for the item B in Table 1; namely, in the case where the temperature of the thermal decomposition section 2*a* increases with reference to its preset temperature, and where there is a decrease in the ratio of the quantity of air to be mixed to the quantity of thermally-decomposed gases that has a peak in the item (e.g., an ion current value) to be measured by the thermally-decomposed gas quality detection means; or there is an increase in the proportion of the thermally-decomposed gases (designated by a curve "b" in FIG. 10), the quantity of supply of combustibles is increased. The quantity of loading of combustibles is returned to the preset level, when or slightly before the time at which the temperature of the thermal decomposition section 2*a* has returned to its preset temperature.

As illustrated in FIG. 9, from the increase in the temperature of the combustion gas in the thermal decomposition section 2*a* with reference to its preset temperature, it is expected that there would have been an increase in the excess air ratio of the thermal decomposition section 2*a*; namely, a reduction in the proportion of combustible components in the thermally-decomposed gases. This agrees with the expectation based on the variations in the temperature illustrated in FIG. 9. In short, the previous fact means that the quantity of supplied solid combustibles has decreased if a constant quantity of air is supplied to the thermal decomposition section 2*a*.

In this case, the quantity of feed of solid combustibles is increased, and the air excess ratio in the thermal decomposition section 2*a* is decreased so as to reduce the temperature of the thermal decomposition section 2*a*. When or slightly before the time at which the temperature of the thermal decomposition section has returned to the preset temperature, the quantity of loading of combustibles is returned to the original quantity.

Next, for the item C in Table 1; namely, in the case where the temperature of the thermal decomposition section 2*a* decreases with reference to its preset temperature, and where there is a decrease in the ratio of (the quantity of air to be mixed) to (the quantity of thermally-decomposed gases) that has a peak in the item to be measured by the thermally-decomposed gas quality detection means; or there is an increase in the proportion of the thermally-decomposed gases, the quantity of air supply to the thermal decomposition section 2*a* is increased. The quantity of air supply is returned to the original quantity, when or slightly before the time at which the temperature of the thermal decomposition section 2*a* has returned to its preset temperature.

The phenomenon of the reduction in the temperature of the thermal decomposition section 2*a* with reference to its preset temperature occurs, as does in the case of the item A. Contrary to the case of the item A, there is the decrease in the ratio of the quantity of air to be mixed to the quantity of thermally-decomposed gases that has a peak in the item to be measured by the thermally-decomposed gas quality detection means. This phenomenon does not occur as a result of mere variations in the quantity of loading of combustibles occurred in the cases of the items A and B.

Reductions in the temperature of the thermal decomposition section 2*a*, as well as in the ratio of the quantity of air to be mixed to the quantity of thermally-decomposed gases, indicate variations in the quality of combustibles. For example, the reduction in the temperature of the thermal decomposition section 2*a* means an increase in the specific heat of the combustibles, and the reduction in the ratio of the quantity of air to be mixed to the quantity of thermally-decomposed gases means a reduction in the proportion of combustible components in the thermally-decomposed gases. A specific example occurred in an actual incinerator is an increase in the proportion of water content in the combustibles.

In this case, it is necessary to increase the excess air ratio of the thermal decomposition section 2*a* in order to increase its temperature. There are two ways to increase the excess air ratio; namely, the first way is to reduce the quantity of supply of combustibles, and the second way is to increase the quantity of air supply to the thermal decomposition section 2*a*. If the quantity of supply of combustibles is reduced, there occurs a further reduction in a rate of combustion in addition to the reduction in the combustion rate due to the increase in the proportion of water content. For this reason, the quantity of air supply is increased in order to suppress the reduction in the combustion rate to a small extent. As a result, the temperature of the thermal decomposition section 2*a* increases, in turn increasing a rate of thermal decomposition. The proportion of combustible components in the thermally-decomposed gases resultantly increases, thereby resulting in stable combustion. The quantity of air supply is returned to the original quantity, when or slightly before the time at which the temperature of the thermal decomposition section 2*a* has returned to its preset temperature.

Next, for the item D in Table 1; namely, in the case where the temperature of the thermal decomposition section 2*a* increases with reference to its preset temperature, and where there is an increase in the ratio of (the quantity of air to be mixed) to (the quantity of thermally-decomposed gases) that has a peak in the item to be measured by the thermally-decomposed gas quality detection means; or there is a reduction in the proportion of the thermally-decomposed gases, the quantity of air supply to the thermal decomposition section 2*a* is decreased. The quantity of air supply is returned to the original quantity, when or slightly before the time at which the temperature of the thermal decomposition section 2*a* has returned to its preset temperature.

The phenomenon of the increase in the temperature of the thermal decomposition section 2*a* with reference to its preset temperature occurs, as does in the case of the item B. Contrary to the case of the item B, there is the increase in the ratio of the quantity of air to be mixed to the quantity of thermally-decomposed gases that has a peak in the item to be measured by the thermally-decomposed gas quality detection means. This phenomenon does not occur as a result of mere variations in the quantity of loading of combustibles occurred in the cases of the items A and B.

Increases in the temperature of the thermal decomposition section 2*a*, as well as in the ratio of the quantity of air to be mixed to the quantity of thermally-decomposed gases, indicate variations in the quality of combustibles. For example, the increase in the temperature of the thermal decomposition section 2*a* means a reduction in the specific heat of the combustibles, and the increase in the ratio of the quantity of air to be mixed to the quantity of thermally-decomposed gases means an increase in the proportion of combustible components in the thermally-decomposed gases. A specific example often occurred in an actual incinerator is a reduction in the proportion of water content in the combustibles or an increase in the proportion of plastic components.

In this case, it is necessary to decrease the excess air ratio of the thermal decomposition section 2*a* in order to decrease its temperature. There are two ways to decrease the excess air ratio; namely, the first way is to increase the quantity of supply of combustibles, and the second way is to decrease the quantity of air supply to the thermal decomposition section 2*a*. If the quantity of supply of combustibles is increased, there occurs a further increase in the combustion rate in addition to the increase in the combustion rate due to the reduction in the proportion of water content or to the increase in the proportion of plastic components. For this reason, the quantity of air supply is reduced in order to suppress the increase in the combustion rate to a small extent. As a result, the temperature of the thermal decomposition section 2*a* decreases, in turn reducing a rate of thermal decomposition. The proportion of combustible components in the thermally-decomposed gases resultantly decreases, thereby resulting in stable combustion. These operations are important for safety operation of a section of the system subjected to thermal load (e.g., a steam boiler). The quantity of air supply is returned to the original quantity, when or slightly before the time at which the temperature of the thermal decomposition section 2*a* has returned to its preset temperature.

As described above, in the eighth embodiment, the quantity of supply of solid combustibles and of air to the thermal decomposition section 2*a* is controlled according to variations in the quality and quantity of the solid combustibles which are expected from variations in the temperature of the thermal decomposition section 2*a* and in the quality of thermally-decomposed gases, thereby resulting in stable combustion. Eventually, highly efficient and low-pollution combustion and safety operation of a section of the system subjected to thermal load can be implemented.

The combustion control method mentioned above has been described in reference to the case where combustibles are supplied during the course of combustion. On the other hand, in a case where combustibles are previously loaded into an incinerator in a lumped manner, and there is no supply of combustibles during the combustion, as are often seen in the case of compact batch incinerators, only the quantity of air supply is controlled.

More specifically, if there is a shift of the peak value of the value measured by the thermally-decomposed gas quality detection means toward the range in which the proportion of the premixed gaseous mixture consisting of air and thermally-decomposed gases in the thermally-decomposed gases is small, the quantity of air supply is increased. In contradistinction to this, if there is a shift of the peak value toward the range in which the proportion of the premixed gaseous mixture consisting of air and thermally-decomposed gases in the thermally-decomposed gases is large, the quantity of air supply is reduced so as to achieve a preset excess air ratio. The compact batch incinerator is principally intended for combustion rather than for utilization of combustion heat and, hence, is principally aimed at operations to effect high-efficient and low-pollution (low-CO, etc.) combustion rather than at operations to suppress variations in the combustion rate.

NINTH EMBODIMENT

Figure 11:
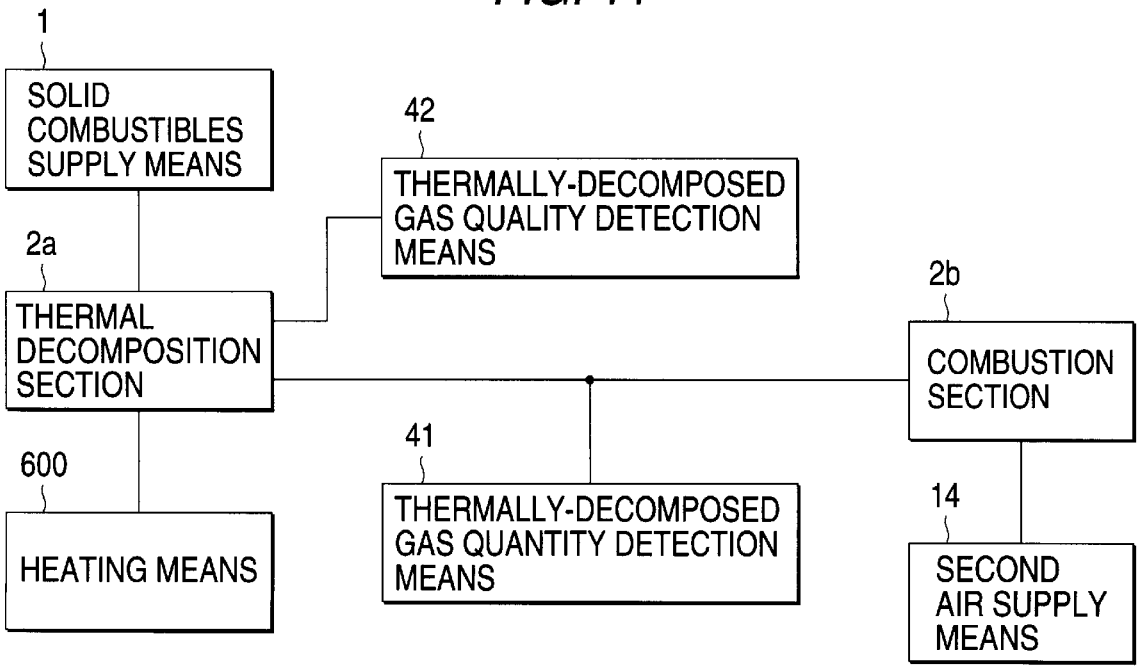
FIG. 11 is a block diagram illustrating the structure of a combustion apparatus according to a ninth embodiment of the present invention.

In the eighth embodiment, an explanation has been given of the method of controlling the operation of the combustion system in which air is supplied to the thermal decomposition section 2*a* by the first air supply means 6. As seen from the structure of a combustion system illustrated in the form of a block diagram in FIG. 11, an explanation will be given of the way to control the operation of the combustion system in which heat is supplied to the thermal decomposition section 2*a* by heating means 600 with regard to the four cases presented in Table 2.

TABLE 2

| | Temp. of a thermal decomposition section | Ratio of (the quantity of air to be mixed)/(the quantity of thermally-decomposed gases) which produces a peak ion current value |
|---|---|---|
| A | Decrease | Small variations |
| B | Increase | Small variations |
| c | Decrease | Reductions (reductions in calorie) |
| D | Increase | Increases (increases in calorie) |

For the item A in Table 2; namely, in the case where the temperature of the thermal decomposition section 2*a* decreases with reference to its preset temperature, and where there are small variations in the ratio of the quantity of air to be mixed to the quantity of thermally-decomposed gases that has a peak in the item (e.g., an ion current value) to be measured by the thermally-decomposed gas quality detection means, the quantity of supply of combustibles is reduced. The quantity of loading of combustibles is returned to the original quantity, when or slightly before the time at which the temperature of the thermal decomposition section 2*a* has returned to the preset temperature.

Provided that a constant quantity of heat is supplied to the thermal decomposition section 2*a*, from the reduction in the temperature of the combustion gas in the thermal decomposition section 2*a* with reference to its preset temperature, it is expected that there would have been an increase in the weight of solid combustibles in the thermal combustion section 2*a* or in the specific heat of the solid combustibles (a specific example often occurring in an incinerator is an increase in water content of the combustibles).

In contrast, the small variations in the ratio of the quantity of air to be mixed to the quantity of thermally-decomposed gases that (is proportional to the excess air ratio) has a peak in the item to be measured by the thermally-decomposed gas quality detection means, mean small variations in the quality of the thermally-decomposed gases.

These imply an increase in the quantity of supplied solid combustibles.

If the increase in the water content of the solid combustibles is caused by; e.g., a reduction in the temperature of the thermal decomposition section 2*a*, the ratio of the quantity of air to be mixed to the quantity of thermally-decomposed gases that has a peak in the item to be measured by the thermally-decomposed gas quality detection means 42, decreases, resulting in a reduction in calories of the thermally-decomposed gases.

Therefore, in this case, the temperature of the thermal decomposition section 2*a* is increased by reducing the quantity of supply of solid combustibles. The quantity of loading of combustibles is returned to the original quantity, when or slightly before the time at which the temperature of the thermal decomposition section 2*a* has returned to the preset temperature.

For the item B in Table 2; namely, in the case where the temperature of the thermal decomposition section 2*a* increases with reference to its preset temperature, and where there are small variations in the ratio of the quantity of air to be mixed to the quantity of thermally-decomposed gases that has a peak in the item to be measured by the thermally-decomposed gas quality detection means, the quantity of supply of combustibles is increased. The quantity of loading of combustibles is returned to the original quantity, when or slightly before the time at which the temperature of the thermal decomposition section 2*a* has returned to the preset temperature.

Provided that a constant quantity of heat is supplied to the thermal decomposition section 2*a*, from the increase in the temperature of the combustion gas in the thermal decomposition section 2*a* with reference to its preset temperature, it is expected that there would have been a reduction in the weight of solid combustibles in the thermal combustion section 2*a* or in the specific heat of the solid combustibles (for example, a reduction in the water content).

In contrast, the small variations in the ratio of the quantity of air to be mixed to the quantity of thermally-decomposed gases that has a peak in the item to be measured by the thermally-decomposed gas quality detection means, mean small variations in the quality of the thermally-decomposed gases.

These imply a reduction in the quantity of supplied solid combustibles.

If the reduction in the water content of the solid combustibles is caused by; e.g., a reduction in the temperature of the thermal decomposition section 2*a*, the ratio of the quantity of air to be mixed to the quantity of thermally-decomposed gases that has a peak in the item to be measured by the thermally-decomposed gas quality detection means 42, increases, resulting in an increase in calories of the thermally-decomposed gases.

Therefore, in this case, the temperature of the thermal decomposition section 2*a* is reduced by increasing the quantity of supply of solid combustibles. The quantity of loading of combustibles is returned to the original quantity, when or slightly before the time at which the temperature of the thermal decomposition section 2*a* has returned to the preset temperature.

Next, for the item C in Table 2; namely, in the case where the temperature of the thermal decomposition section 2*a* decreases with reference to its preset temperature, and where there is a reduction in the ratio of the quantity of air to be mixed to the quantity of thermally-decomposed gases that has a peak in the item to be measured by the thermally-decomposed gas quality detection means; or there is an increase in the proportion of the thermally-decomposed gases, the quantity of supply of heat to the thermal decomposition section 2*a* is increased. The quantity of supply of heat is returned to the original quantity, when or slightly before the time at which the temperature of the thermal decomposition section 2*a* has returned to the preset temperature.

The phenomenon of the reduction in the temperature of the thermal decomposition section 2*a* with reference to its preset temperature occurs, as does in the case of the item A. Contrary to the case of the item A, there is the reduction in the ratio of the quantity of air to be mixed to the quantity of thermally-decomposed gases that has a peak in the item to be measured by the thermally-decomposed gas quality detection means. This phenomenon does not occur as a result of mere variations in the quantity of loading of combustibles occurred in the cases of the items A and B.

Reductions in the temperature of the thermal decomposition section 2*a*, as well as in the ratio of the quantity of air to be mixed to the quantity of thermally-decomposed gases, indicate variations in the quality of combustibles. For example, the reduction in the temperature of the thermal decomposition section 2*a* means an increase in the specific heat of the combustibles, and the reduction in the ratio of the quantity of air to be mixed to the quantity of thermally-decomposed gases means a reduction in the proportion of combustible components in the thermally-decomposed gases. A specific example occurred in an actual incinerator is an increase in the proportion of water content in the combustibles.

In this case, there are two ways to increase the temperature of the thermal decomposition section 2*a*; namely, the first way is to reduce the quantity of supply of combustibles, and the second way is to increase the quantity of heat supply to the thermal decomposition section 2*a*. If the quantity of supply of combustibles is reduced, there is a further reduction in the quantity of thermally-decomposed gases in addition to the reduction in the quantity of generation of thermally-decomposed gases due to the increase in the proportion of water content. For this reason, the quantity of heat supply is increased in order to suppress the reduction in the quantity of generation of thermally-decomposed gases to a small extent. As a result, the temperature of the thermal decomposition section 2*a* increases, in turn increasing the rate of thermal decomposition. The quantity of thermally-decomposed gases resultantly increases, thereby resulting in stable combustion. The quantity of supply of heat is returned to the original quantity, when or slightly before the time at which the temperature of the thermal decomposition section 2*a* has returned to its preset temperature.

Next, for the item D in Table 2; namely, in the case where the temperature of the thermal decomposition section 2*a* increases with reference to its preset temperature, and where there is an increase in the ratio of the quantity of air to be mixed to the quantity of thermally-decomposed gases that has a peak in the item to be measured by the thermally-decomposed gas quality detection means; or there is a reduction in the proportion of the thermally-decomposed gases, the quantity of heat supply to the thermal decomposition section 2*a* is decreased. The quantity of supply of heat is returned to the original quantity, when or slightly before the time at which the temperature of the thermal decomposition section 2*a* has returned to its preset temperature.

The phenomenon of the increase in the temperature of the thermal decomposition section 2*a* with reference to its preset temperature occurs, as does in the case of the item B. Contrary to the case of the item B, there is the increase in the ratio of the quantity of air to be mixed to the quantity of thermally-decomposed gases that has a peak in the item to be measured by the thermally-decomposed gas quality detection means. This phenomenon does not occur as a result of mere variations in the quantity of loading of combustibles occurred in the cases of the items A and B.

Increases in the temperature of the thermal decomposition section 2*a*, as well as in the ratio of the quantity of air to be mixed to the quantity of thermally-decomposed gases, indicate variations in the quality of combustibles. For example, the increase in the temperature of the thermal decomposition section 2*a* means a reduction in the specific heat of the combustibles, and the increase in the ratio of the quantity of air to be mixed to the quantity of thermally-decomposed gases means an increase in the proportion of combustible components in the thermally-decomposed gases. A specific example often occurred in an actual incinerator is a reduction in the proportion of water content in the combustibles or an increase in the proportion of plastic components.

In this case, there are two ways to decrease the temperature of the thermal decomposition section 2*a*; namely, the first way is to increase the quantity of supply of combustibles, and the second way is to decrease the quantity of supply of heat to the thermal decomposition section 2*a*. If the quantity of supply of combustibles is increased, there is a further increase in the quantity of thermally-decomposed gasses in addition to the increase in the quantity of generation of thermally-decomposed gases caused by the reduction in the proportion of water content or to the increase in the proportion of plastic components. For this reason, the quantity of supply of heat is reduced in order to suppress the increase in the quantity of thermally-decomposed gases to a small extent. As a result, the temperature of the thermal decomposition section 2*a* decreases, in turn reducing the rate of thermal decomposition. The quantity of thermally-decomposed gases resultantly decreases, thereby resulting in stable combustion. These operations are important for safety operation of a section of the system subjected to thermal load (e.g., a steam boiler). The quantity of supply of heat is returned to the original quantity, when or slightly before the time at which the temperature of the thermal decomposition section 2*a* has returned to its preset temperature.

As described above, in the ninth embodiment, the quantity of supply of solid combustibles and of heat to the thermal decomposition section 2*a* is controlled according to variations in the quality and quantity of the solid combustibles which are expected from variations in the temperature of the thermal decomposition section 2*a* and in the quality of thermally-decomposed gases, thereby resulting in stable combustion. Eventually, high-efficient and low-pollution combustion and safety operation of a section of the system subjected to thermal load can be implemented.

The combustion control method mentioned above has been described in reference to the case where combustibles are supplied during the course of combustion. On the other hand, in a case where combustibles are previously loaded into an incinerator in a lumped manner, and there is no supply of combustibles during the combustion, as are often seen in the case of compact batch incinerators, only the quantity of air supply is controlled.

More specifically, if there is a shift of the peak value of the value measured by the thermally-decomposed gas quality detection means toward the range in which the proportion of the premixed gaseous mixture consisting of air and thermally-decomposed gases in the thermally-decomposed gases is small, the quantity of supply of heat is increased. In contradistinction to this, if there is a shift of the peak value toward the range in which the proportion of the premixed gaseous mixture consisting of air and thermally-decomposed gases in the thermally-decomposed gases is large, the quantity of supply of heat is reduced so as to achieve a preset excess air ratio. The compact batch incinerator is principally intended for combustion rather than for utilization of combustion heat and, hence, is principally aimed at operations to effect high-efficient and low-pollution (low-CO, etc.) combustion rather than at operations to suppress variations in the combustion rate.

The thermally-decomposed gases developed in the thermal decomposition section 2*a* may be used as the source of heat of the heating means 600 of the thermal decomposition section 2*a*. In this case, the energy-saving characteristics of the combustion system are improved.

Although an explanation has been given of the case where the method of controlling the operation of the combustion system, according to the eighth embodiment, in which air is supplied to the thermal decomposition section 2*a* is applied to the combustion system in which heat is supplied to the thermal decomposition section 2*a*, it goes without saying that the operation control methods for use with the combustion systems of the first, and third to seventh embodiments can be applied to the combustion system in which heat is supplied to the thermal decomposition section 2*a*.

The combustion systems illustrated in the respective embodiments are capable of detecting the quality of combustible gases developed in the thermal decomposition section 2*a*, and hence they are particularly effective in burning solid combustibles having variable quality such as coals, industrial waste, municipal solid waste, polluted sludge, or a mixture thereof.

In the previous embodiments, the explanations have been given of the cases where the quantity of air to be supplied to the combustion section 2*b* is controlled by detection of the quality and quantity of thermally-decomposed gases developed in the thermal decomposition section 2*a* or a flow rate of air to be supplied to the thermal decomposition section 2*a*, and where the quantity of solid combustibles and air (or the quantity of supply of heat) to be supplied to the thermal decomposition section 2*a* by detection of the quality and temperature of the thermally-decomposed gases developed in the thermal decomposition section 2*a*. However, the present invention is not limited to these illustrative embodiments. Needless to say, items to be detected other than the previously-described items may be controlled while they are in combination of the previous items by utilization of the real-time detection of the quality of thermally-decomposed gases developed in the thermal decomposition section 2*a* (e.g., a stoichiometric air-to-fuel ratio or a quasi stoichiometric air-to-fuel ratio).

As has been described above, the present invention provides a combustion system including solid combustibles supply means, a thermal decomposition section which generates combustible gases by thermally decomposing or partially burning the solid combustibles received from the solid combustibles supply means, a combustion section which burns the combustible gases generated in the thermal decomposition section, first air supply means which supplies air to heating means for heating the thermal decomposition section or to the thermal decomposition section, and second air supply means which supplies air to the combustion section, the improvement being characterized by comprising thermally-decomposed gas quality detection means for detecting the quality of the combustible gases generated in the thermal decomposition section. As a result, it becomes possible to ascertain the quality of the combustible gases. Therefore, even in the case of solid combustibles having variable quality such as coals, industrial waste, municipal solid waste, polluted sludge, or a mixture thereof, it is possible to control the combustion system according to variations in the quality of combustible gases on the basis of variations in the quality and quantity of supplied solid combustibles.

The combustion system further comprises thermally-decomposed gas quantity detection means for detecting the quantity of the combustible gases generated by the thermal decomposition section or airflow rate detection means for detecting a flow rate of air supplied to the thermal decomposition section. As a result, combustion air can be supplied to the combustion section according to the quality and quantity of combustible gases or to a flow rate of air supplied to the thermal decomposition section. Stable combustion can be effected at all times in spite of variations in the quality and quantity of combustible gases, as a result of which enables high-efficient and low-pollution combustion and safety operation of a section of the system subjected to thermal load.

The combustion system further comprises thermal decomposition section temperature detection means which detects the temperature of the combustible gases developed in the thermal decomposition section. From the quality and temperature of the combustible gas in the thermal decomposition section, it is possible to estimate the cause of variations in the temperature of the thermal decomposition section. If the quantity of supply of solid combustibles and air to the thermal decomposition section is controlled in consideration of the thus-estimated cause, it is possible to maintain the temperature of the thermal decomposition section optimum and to effect stable combustion at all times. The thermally-decomposed gas quality detection means detects a stoichiometric air-to-fuel ratio or a quasi stoichiometric air-to-fuel ratio by comparing to each other the magnitudes of ion currents of, or temperatures of, a plurality of premixed flames whose mixture ratio of the combustible gases to air is changed stepwise. The plurality of premixed flames are generated substantially in alignment with the generator of an imaginary cone in such a way that they partially come into contact with each other. Even if a portion of the premixed flames is extinguished, the other existing premixed flames serve as pilot light, which enables a group of premixed flames to keep burning at all times in spite of variations in the quality of combustible gases.

A source for ignition of the premixed flames is disposed in the vicinity of the vertex of the imaginary cone, which enables ignition of a plurality of premixed flames at one time.

One common electrode for detecting ion currents is provided substantially in alignment with the center axis of the imaginary cone so as to come into contact with the plurality of premixed flames, and ion currents of the respective premixed flames are measured with time lags through use of the common electrode. As a result, the number of ion current detection electrodes can be reduced, which enables simplification of the structure of the thermally-decomposed gas quality detection means and cost-cutting thereof.

The plurality of premixed flames are formed in a lower-pressure vessel rather than in the thermal decomposition section. Therefore, even if the thermal decomposition section is in a reduced pressure, combustible gases can be supplied to the thermally-decomposed gas quality detection means.

An operation control method of the present invention comprises the steps of detecting the quantity of combustible gases developed in the thermal decomposition section by means of the thermally-decomposed gas quantity detection means; detection a stoichiometric air-to-fuel ratio or quasi stoichiometric air-to-fuel ratio of the combustible gases by means of the thermally-decomposed gas quality detection means; and supplying to the combustion section the quantity of air which is obtained by multiplying the product of the thus-detected quantity of combustible gases and the stoichiometric air-to-fuel ratio or quasi stoichiometric air-to-fuel ratio, by a predetermined factor by means of the second air supply means. Highly efficient combustion which involves very small concentrations of unburned hydrocarbon and CO in an exhaust gas can be achieved.

So long as the quantity of combustible gases developed in the thermal decomposition section is estimated by multiplying the quantity of air supplied to the thermal decomposition section by a predetermined factor, the thermally-decomposed gas quantity detection means becomes unnecessary, which renders the combustion system inexpensive.

If the temperature of the combustible gases developed in the thermal decomposition section by means of the thermal decomposition section temperature detection means is detected, a stoichiometric air-to-fuel ratio or quasi stoichiometric air-to-fuel ratio of the combustible gases developed in the thermal decomposition section by means of the thermally-decomposed gas quality detection means is detected, and at least either the feed rate of the solid combustibles by means of the solid combustibles supply means or the feed rate of air by the first air supply means is changed on the basis of variations in the thus-detected temperature of the combustible gases and in the stoichiometric air-to-fuel ratio or quasi stoichiometric air-to-fuel ratio of the combustible gases, it becomes possible to maintain the temperature of the thermal decomposition section optimum and to effect stable combustion at all times.

If the temperature of the combustible gases developed in the thermal decomposition section by means of the thermal decomposition section temperature detection means is detected, a stoichiometric air-to-fuel ratio or quasi stoichiometric air-to-fuel ratio of the combustible gases developed in the thermal decomposition section by means of the thermally-decomposed gas quality detection means is detected, and at least either the feed rate of the solid combustibles by means of the solid combustibles supply means or a heating rate of heating means is changed on the basis of variations in the thus-detected temperature of the combustible gases and in the stoichiometric air-to-fuel ratio or quasi stoichiometric air-to-fuel ratio of the combustible gases, it becomes possible to maintain the temperature of the thermal decomposition section optimum and to effect stable combustion at all times.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A combustion system comprising:

solid combustibles supply means for supplying solid combustibles;

a thermal decomposition section connected to said solid combustibles supply means for generating combustible gases by thermally decomposing or partially burning the solid combustibles which are received from said solid combustible supply means;

a combustion section connected to said thermal decomposition section for receiving and burning the combustible gases generated by said thermal decomposition section;

thermally-decomposed gas quality detection means for detecting a stoichiometric air-to-fuel ratio of the combustible gases generated by said thermal decomposition section; and air supply means for supplying air to said combustion section in accordance with the stoichiometric air-to-fuel ratio of the combustible gases detected by said thermally-decomposed gas quality detection means.

2. The combustion system as defined in claim 1, further comprising thermally-decomposed gas quantity detection means for detecting the quantity of the combustible gases generated by said thermal decomposition section or airflow rate detection means for detecting a flow rate of air supplied to the thermal decomposition section.

3. The combustion system as defined in claim 1, further comprising thermal decomposition section temperature detection means for detecting a temperature of the combustible gases generated in the thermal decomposition section.

4. The combustion system as defined in claim 1, further comprising one of thermal decomposition air supply means for supplying air to said thermal decomposition means, and heating means for providing heat to said thermal decomposition means.

5. The combustion system as defined in claim 4, wherein said thermally-decomposed gas quality detection means comprises a plurality of premixed flames each having a different mixture ratio of the combustible gases to air, and said thermally-decomposed gas quality section detects the stoichiometric air-to-fuel ratio based on ion currents or temperatures of the plurality of premixed flames.

6. The combustion system as defined in claim 5, wherein the plurality of premixed flames are arranged so that the premixed flames partially come into contact with each other.

7. The combustion system as defined in claim 6, wherein said thermally-decomposed gas quality detection means further comprises a source for ignition of the premixed flames.

8. The combustion system as defined in claim 6, wherein said thermally-decomposed gas quality detection means further comprises a common electrode for detecting the ion currents of said plurality of premixed flames.

9. The combustion system as defined in claim 5, wherein the thermally-decomposed gas quality detection means are formed in a vessel having a lower pressure than the thermal decomposition section.

10. The combustion system as defined in claim 1, wherein the solid combustibles are coals, industrial waste, municipal solid waste, polluted sludge, or a mixture thereof.

11. A method of controlling the operation of a combustion system comprising a thermal decomposition section for generating combustible gases by thermally decomposing or partially burning solid combustibles and a combustion section for receiving and burning the combustible gases generated by said thermal decomposition section, the method comprising the steps of:

detecting a quantity of combustible gases generated by the thermal decomposition section;

detecting a stoichiometric air-to-fuel ratio of the combustible gases generated by the thermal decomposition chamber; and supplying air to the combustion section based on the quantity of combustible gases and the stoichiometric air-to-fuel ratio.

12. A method of controlling the operation of combustion system comprising a thermal decomposition section for generating combustible gases by thermally decomposing or partially burning solid combustibles and a combustion section for receiving and burning the combustible gases generated by said thermal decomposition section, the method comprising the steps of:

detecting a flow rate of air supplied to the thermal decomposition section;

detecting a stoichiometric air-to-fuel ratio of the combustible gases developed in the thermal decomposition section;

calculating a quantity of the combustible gases generated by the thermal decomposition section by multiplying the flow rate of air by a predetermined factor; and supplying air to the combustion section in accordance with the quantity of combustible gases and the stoichiometric air-to-fuel ratio.

13. A method of controlling the operation of a combustion system comprising a thermal decomposition section for generating combustible gases by thermally decomposing or partially burning solid combustibles and a combustion section for receiving and burning the combustible gases generated by said thermal decomposition section, the method comprising the steps of:

detecting the temperature of the combustible gases developed in the thermal decomposition section;

detecting a stoichiometric air-to-fuel ratio of the combustible gases developed in the thermal decomposition section; and changing at least one of a supply rate of the solid combustibles to the thermal decomposition section, a supply rate of air to the thermal decomposition section, and a heating rate of the thermal decomposition section, based on the detected temperature of the combustible gases and the stoichiometric air-to-fuel ratio of the combustible gases.

* * * * *